US008985704B2

(12) United States Patent
Zimmerman et al.

(10) Patent No.: US 8,985,704 B2
(45) Date of Patent: Mar. 24, 2015

(54) CONTINUOUS-EXTRACTION MINING SYSTEM

(71) Applicant: Joy MM Delaware, Inc., Wilmington, DE (US)

(72) Inventors: Joseph J. Zimmerman, Franklin, PA (US); David Kevin Herdle, Franklin, PA (US); Tyler Good, Pleasantville, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 13/739,368

(22) Filed: Jan. 11, 2013

(65) Prior Publication Data

US 2013/0119745 A1 May 16, 2013

Related U.S. Application Data

(63) Continuation-in-part of application No. 13/179,285, filed on Jul. 8, 2011, and a continuation-in-part of application No. 13/179,266, filed on Jul. 8, 2011.

(60) Provisional application No. 61/362,949, filed on Jul. 9, 2010, provisional application No. 61/435,121, filed on Jan. 21, 2011.

(51) Int. Cl.
*E21C 35/20* (2006.01)
*E21F 13/00* (2006.01)
(Continued)

(52) U.S. Cl.
CPC ..... *E21F 13/00* (2013.01); *E21F 13/002* (2013.01); *E21F 13/025* (2013.01);
(Continued)

(58) Field of Classification Search
USPC ..... 241/101.5, 101.2, 186.35, 264, 266; 299/11, 12, 18, 19, 64, 65; 104/154, 104/162; 105/29.1, 31, 127; 414/565, 685; 198/317, 520
See application file for complete search history.

(56) References Cited

U.S. PATENT DOCUMENTS 1,215,692 A 2/1917 Norris
1,244,203 A 10/1917 Hawkesworth
(Continued)

FOREIGN PATENT DOCUMENTS

CN 1706734 12/2005
CN 2929185 8/2007
(Continued)

OTHER PUBLICATIONS

PCT/US2011/043412 International Search Report and Written Opinion dated Dec. 8, 2011 (16 pages).
(Continued)

*Primary Examiner* — Sunil Singh
(74) *Attorney, Agent, or Firm* — Michael Best & Friedrich LLP

(57) ABSTRACT

A material extraction system is provided for an underground mine. The mine includes a roadway entry and a draw-bell entry intersecting the roadway entry and affording access to a draw-bell. The system generally includes a loader movable from the roadway entry into the draw-bell entry for removing material from the draw-bell, a sizer coupled to the loader for sizing the removed material, a material collector operable to collect the sized material, and a shuttle car operable to receive the collected material from the material collector. The material collector has a loading end and a discharge end, and material transport device extending therebetween. The shuttle car is movable along the roadway entry for transferring the collected material so as to facilitate a substantially continuous extraction of the material.

22 Claims, 15 Drawing Sheets

(51) Int. Cl.

| | |
|---|---|
| ***E21F 13/02*** | (2006.01) |
| ***E21F 13/06*** | (2006.01) |
| ***E02F 3/96*** | (2006.01) |
| ***E02F 7/02*** | (2006.01) |
| ***E02F 7/04*** | (2006.01) |
| ***E02F 7/06*** | (2006.01) |

(52) U.S. Cl.

CPC ..... *E21F 13/063* (2013.01); *E02F 3/962* (2013.01); *E02F 3/966* (2013.01); *E02F 7/026* (2013.01); *E02F 7/04* (2013.01); *E02F 7/06* (2013.01)

USPC ..... 299/64; 299/19

(56) References Cited

U.S. PATENT DOCUMENTS

| | | | | |
|---|---|---|---|---|
| 1,281,379 | A | 10/1918 | Hudson | |
| 1,293,447 | A | 2/1919 | Huhn | |
| 1,345,991 | A | 7/1920 | Brown | |
| 1,449,088 | A | 3/1923 | Burnell | |
| 1,464,742 | A | 8/1923 | Billings et al. | |
| RE15,685 | E | 9/1923 | Hoar | |
| 1,481,211 | A | 1/1924 | Keech et al. | |
| 1,514,008 | A | 11/1924 | Mosier | |
| 1,520,247 | A | 12/1924 | Jacobsen | |
| 1,601,134 | A | 9/1926 | Mattinson et al. | |
| 1,702,519 | A | 2/1929 | Newdick | |
| 1,735,122 | A | 11/1929 | Mattinson et al. | |
| 1,832,965 | A | 11/1931 | Christopher | |
| 1,836,250 | A | 12/1931 | Holmes | |
| 2,003,007 | A | 5/1935 | Morgan | |
| 2,064,104 | A | 12/1936 | Cartlidge | |
| 2,188,790 | A | 1/1940 | Levin | |
| 2,724,515 | A | 11/1955 | Scheuchzer et al. | |
| 2,796,999 | A | 6/1957 | Russell | |
| 2,874,945 | A * | 2/1959 | McWhorter | 299/11 |
| 2,946,296 | A | 7/1960 | Jones | |
| 2,992,722 | A | 7/1961 | Moon | |
| 3,077,841 | A | 2/1963 | Lunde | |
| 3,145,057 | A | 8/1964 | Taggart | |
| 3,167,193 | A | 1/1965 | Klosk | |
| 3,206,048 | A * | 9/1965 | Vlastimil et al. | 414/565 |
| 3,220,355 | A | 11/1965 | Jones | |
| 3,246,610 | A | 4/1966 | Lindstrom | |
| 3,272,357 | A | 9/1966 | Freni | |
| 3,301,599 | A | 1/1967 | Heimaster | |
| 3,307,718 | A | 3/1967 | Sjostrom | |
| 3,339,493 | A | 9/1967 | Bryan, Jr. | |
| 3,353,504 | A | 11/1967 | Kersey et al. | |
| 3,376,832 | A | 4/1968 | Flowers | |
| 3,516,712 | A | 6/1970 | Bennett et al. | |
| 3,547,287 | A | 12/1970 | Cunningham, Sr. | |
| 3,598,061 | A | 8/1971 | Flowers | |
| 3,610,165 | A | 10/1971 | Browne et al. | |
| 3,717,108 | A | 2/1973 | Thompson, Jr. | |
| 3,731,410 | A | 5/1973 | Cripe | |
| 3,757,701 | A | 9/1973 | Lepley et al. | |
| 3,796,298 | A | 3/1974 | Russell | |
| 3,841,236 | A | 10/1974 | Hammonds et al. | |
| 3,854,421 | A | 12/1974 | Widiger et al. | |
| 3,875,868 | A | 4/1975 | Martin, Jr. | |
| 3,905,306 | A | 9/1975 | Janes | |
| 3,907,093 | A | 9/1975 | Skibo | |
| 3,951,459 | A | 4/1976 | Honeycutt, Jr. | |
| 3,958,830 | A | 5/1976 | Johns | |
| 3,960,408 | A | 6/1976 | Johns | |
| 3,980,340 | A | 9/1976 | Johns | |
| 4,007,693 | A | 2/1977 | Desourdy | |
| 4,017,122 | A | 4/1977 | Simpson | |
| 4,103,972 | A | 8/1978 | Kochanowsky | |
| 4,212,250 | A | 7/1980 | Burgess | |
| 4,240,665 | A | 12/1980 | Hubbard et al. | |
| 4,291,777 | A | 9/1981 | Yale | |
| 4,339,031 | A | 7/1982 | Densmore | |
| 4,373,856 | A | 2/1983 | Taylor | |
| 4,379,672 | A | 4/1983 | Hunter | |
| 4,418,872 | A | 12/1983 | Nelson | |
| 4,466,667 | A | 8/1984 | Poulsen | |
| 4,490,086 | A | 12/1984 | Luck | |
| 4,537,554 | A | 8/1985 | Collins, Jr. | |
| 4,571,145 | A | 2/1986 | Hunter | |
| 4,625,438 | A | 12/1986 | Mozer | |
| 4,700,023 | A | 10/1987 | Hillmann et al. | |
| 4,749,078 | A | 6/1988 | Mraz | |
| 4,754,710 | A | 7/1988 | Kieres | |
| 4,767,253 | A | 8/1988 | Luck | |
| 4,773,520 | A | 9/1988 | Doerr et al. | |
| 4,781,125 | A | 11/1988 | Friedenthal | |
| 4,784,257 | A | 11/1988 | Doerr | |
| 4,798,279 | A | 1/1989 | Doerr et al. | |
| 4,890,720 | A | 1/1990 | Brais | |
| 4,906,133 | A | 3/1990 | Martin | |
| 4,953,915 | A | 9/1990 | Jasser et al. | |
| 4,957,405 | A | 9/1990 | Roberts et al. | |
| 4,960,306 | A | 10/1990 | Kipp et al. | |
| 5,112,111 | A | 5/1992 | Addington et al. | |
| 5,120,182 | A | 6/1992 | Hvolka | |
| 5,154,489 | A | 10/1992 | Lemieux | |
| 5,176,491 | A | 1/1993 | Houkom | |
| 5,427,439 | A | 6/1995 | Herickhoff | |
| 5,549,359 | A | 8/1996 | Hoss et al. | |
| 5,709,433 | A | 1/1998 | Christopher et al. | |
| 5,810,447 | A | 9/1998 | Christopher et al. | |
| 5,967,616 | A | 10/1999 | Offutt et al. | |
| 6,022,068 | A | 2/2000 | D'Amico | |
| 6,086,159 | A | 7/2000 | Peterson | |
| 6,267,191 | B1 | 7/2001 | Hettinger | |
| 6,505,892 | B1 | 1/2003 | Walker et al. | |
| 6,547,336 | B2 | 4/2003 | Hoffmann | |
| 6,745,502 | B1 | 6/2004 | Desmarais et al. | |
| 7,232,029 | B1 | 6/2007 | Benedict et al. | |
| 7,740,323 | B2 | 6/2010 | Kaneko et al. | |
| 7,770,673 | B2 | 8/2010 | Allen et al. | |
| 2002/0081183 | A1 | 6/2002 | Wilson | |
| 2003/0111892 | A1 | 6/2003 | Neilson et al. | |
| 2004/0251732 | A1 * | 12/2004 | Lowery | 299/95 |
| 2010/0114404 | A1 | 5/2010 | Donnelly | |
| 2011/0175427 | A1 | 7/2011 | Nakate et al. | |
| 2011/0278384 | A1 | 11/2011 | Ange, III | |
| 2012/0007412 | A1 | 1/2012 | Zimmerman | |

FOREIGN PATENT DOCUMENTS

| | | | |
|---|---|---|---|
| GB | 626675 | | 7/1949 |
| GB | 2172322 | A * | 9/1986 |
| JP | 02147800 | | 6/1990 |
| PL | 52781 | | 6/1992 |
| PL | 164371 | | 7/1994 |
| PL | 167662 | | 10/1995 |
| PL | 169974 | | 9/1996 |
| PL | 170752 | | 1/1997 |
| PL | 312596 | | 8/1997 |
| PL | 317385 | | 6/1998 |
| PL | 200558 | | 1/2009 |
| PL | 387224 | | 8/2010 |

OTHER PUBLICATIONS

PCT/US2011/043416 International Search Report and Written Opinion dated Dec. 9, 2011 (18 pages).

PCT/US2011/043412 International Preliminary Report on Patentability dated Jan. 15, 2013 (9 pages).

PCT/US2011/043416 International Preliminary Report on Patentability dated Jan. 15, 2013 (8 pages).

PCT/US2013/021154 International Search Report and Written Opinion dated Mar. 22, 2013 (14 pages).

PL402402 Polish Search Report dated Mar. 5, 2013 (1 page).

P402403 Search Report from the Patent Office of the Republic of Poland dated Jul. 30, 2013 (4 pages).

Office Action from the United States Patent and Trademark Office for U.S. Appl. No. 13/850,094 dated Feb. 13, 2014 (8 pages).

Office Action from the United States Patent and Trademark Office for U.S. Appl. No. 13/179,266 dated Apr. 1, 2014 (28 pages).

(56) References Cited

OTHER PUBLICATIONS

Office Action from the United States Patent and Trademark Office for U.S. Appl. No. 13/179,285 dated Apr. 9, 2014 (31 pages).
First Office Action from the State Intellectual Property Office of the People's Republic of China for Application No. 2011800428998 dated Apr. 30, 2014 (14 pages).
First Office Action from the Australian Intellectual Property Office for Application No. 2011274438 dated Apr. 28, 2014 (4 pages).
First Office Action from the Australian Intellectual Property Office for Application No. 2011274435 dated Apr. 23, 2014 (4 pages).
Office Action for U.S. Appl. No. 13/850,094 dated May 19, 2014 (9 pages).
First Office Action from the State Intellectual Property Office of the People's Republic of China for Chinese Application No. 201180042890.7 dated May 28, 2014 (22 pages).

* cited by examiner

CONTINUOUS-EXTRACTION MINING SYSTEM

CROSS-REFERENCE TO RELATED APPLICATIONS

This application claims priority to and is a continuation-in-part of prior application Ser. No. 13/179,285, filed Jul. 8, 2011, which claims the benefit of U.S. Provisional Application No. 61/362,949, filed Jul. 9, 2010, and U.S. Provisional Application No. 61/435,121, filed Jan. 21, 2011. This application also claims priority to and is a continuation-in-part of prior application Ser. No. 13/179,266, filed Jul. 8, 2011, which claims the benefit of U.S. Provisional Application No. 61/362,949, filed Jul. 9, 2010, and U.S. Provisional Application No. 61/435,121, filed Jan. 21, 2011. Application Ser. No. 13/179,285 published as Publication No. 2012/0007413 on Jan. 12, 2012, and application Ser. No. 13/179,266 published as Publication No. 2012/0007412 on Jan. 12, 2012. The entire contents of each of the foregoing applications are incorporated by reference herein.

BACKGROUND

In underground hard-rock mining, a process called block caving can be used. In this process, an ore body is typically preconditioned by fracturing the ore via various methods. Conical or tapered voids are then drilled at the bottom of the ore body, and the void is blasted. The fractured ore body above the blast will cave, and, through gravity, fall or settle down into collection areas called draw-bells. The draw-bells serve as discharge points to an entryway. Load-haul-dump vehicles typically tram through the entryway to load ore from the draw-bell. The vehicles haul the ore through various other entryways to a centrally-located dump point and dump the ore into an underground crusher that has been installed at the dump point. The crushed ore subsequently is fed to a conveyor system to be conveyed out of the mine. As more ore is removed from the draw-bells, the ore body caves in further, providing a continuous stream of ore.

SUMMARY

In some embodiments, a material extraction system is provided for an underground mine. The mine includes a roadway entry and a draw-bell entry intersecting the roadway entry and affording access to a draw-bell. The system generally includes a loader movable from the roadway entry into the draw-bell entry for removing material from the draw-bell, a sizer coupled to the loader for sizing the removed material, a material collector operable to collect the sized material, and a shuttle car operable to receive the collected material from the material collector. The material collector has a loading end and a discharge end, and a material transport device extending therebetween. The shuttle car is movable along the roadway entry for transferring the collected material so as to facilitate a substantially continuous extraction of the material.

In other embodiments, a method of extracting material is provided for an underground mine. The mine includes a roadway entry and a draw-bell entry intersecting the roadway entry and affording access to a draw-bell. The method generally includes moving a loader from the roadway entry into the draw-bell entry, removing material from the draw-bell using the loader, sizing the removed material using a sizer that is coupled to the loader, collecting the sized material on a material collector, and transferring the collected material along the roadway entry using a shuttle car so as to facilitate a continuous extraction of the material.

In still other embodiments, a material extraction system is provided for an underground mine. The mine includes a roadway entry and a draw-bell entry intersecting the roadway entry and affording access to a draw-bell. The system generally includes a loader movable from the roadway entry into the draw-bell entry for removing material from the draw-bell, a sizer coupled to the loader for sizing the removed material on a substantially continuous basis, a material collector operable to collect the sized material, and a shuttle car operable to receive the collected material from the material collector. The material collector has a loading end and a discharge end, a material transport device extending therebetween, and wheels engageable with a mine floor. The shuttle car includes steerable wheels engageable with a mine floor for moving along the roadway entry for transferring the collected material so as to facilitate a substantially continuous extraction of the material.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
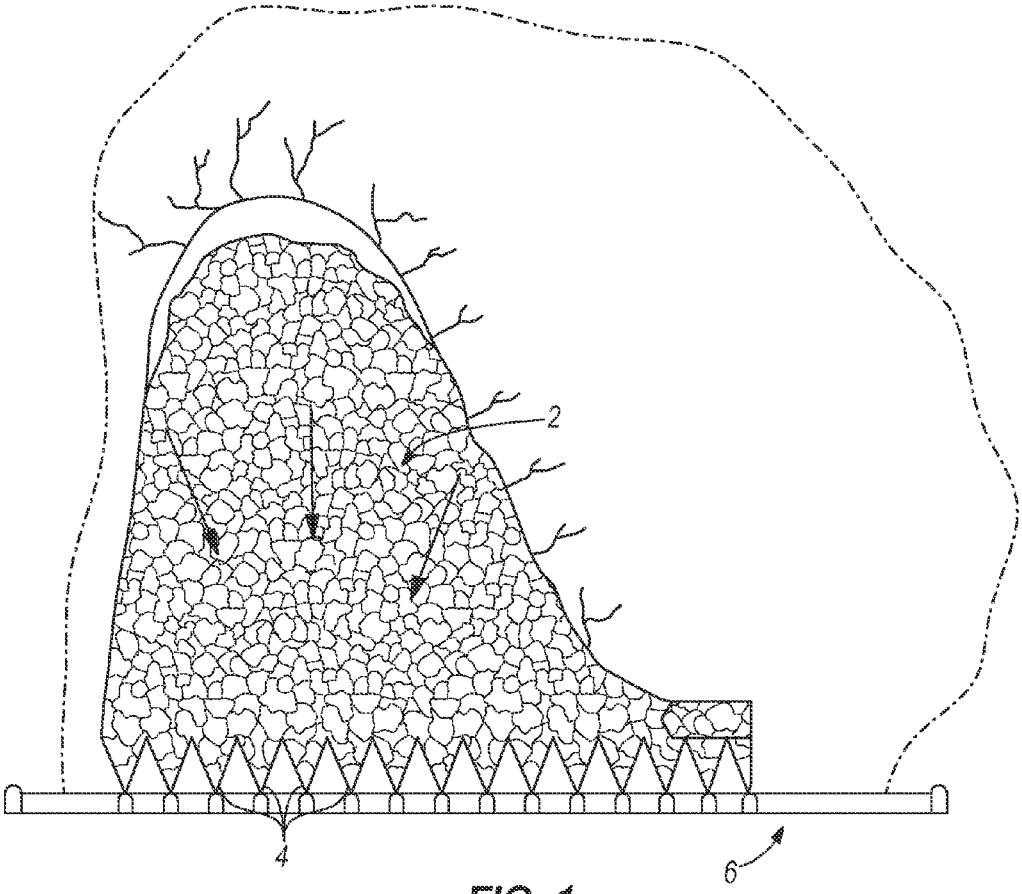
FIG. 1 is a schematic diagram of a block caving mining setup depicting an ore body, draw-bells, and undercut entryway.
Figure 2:
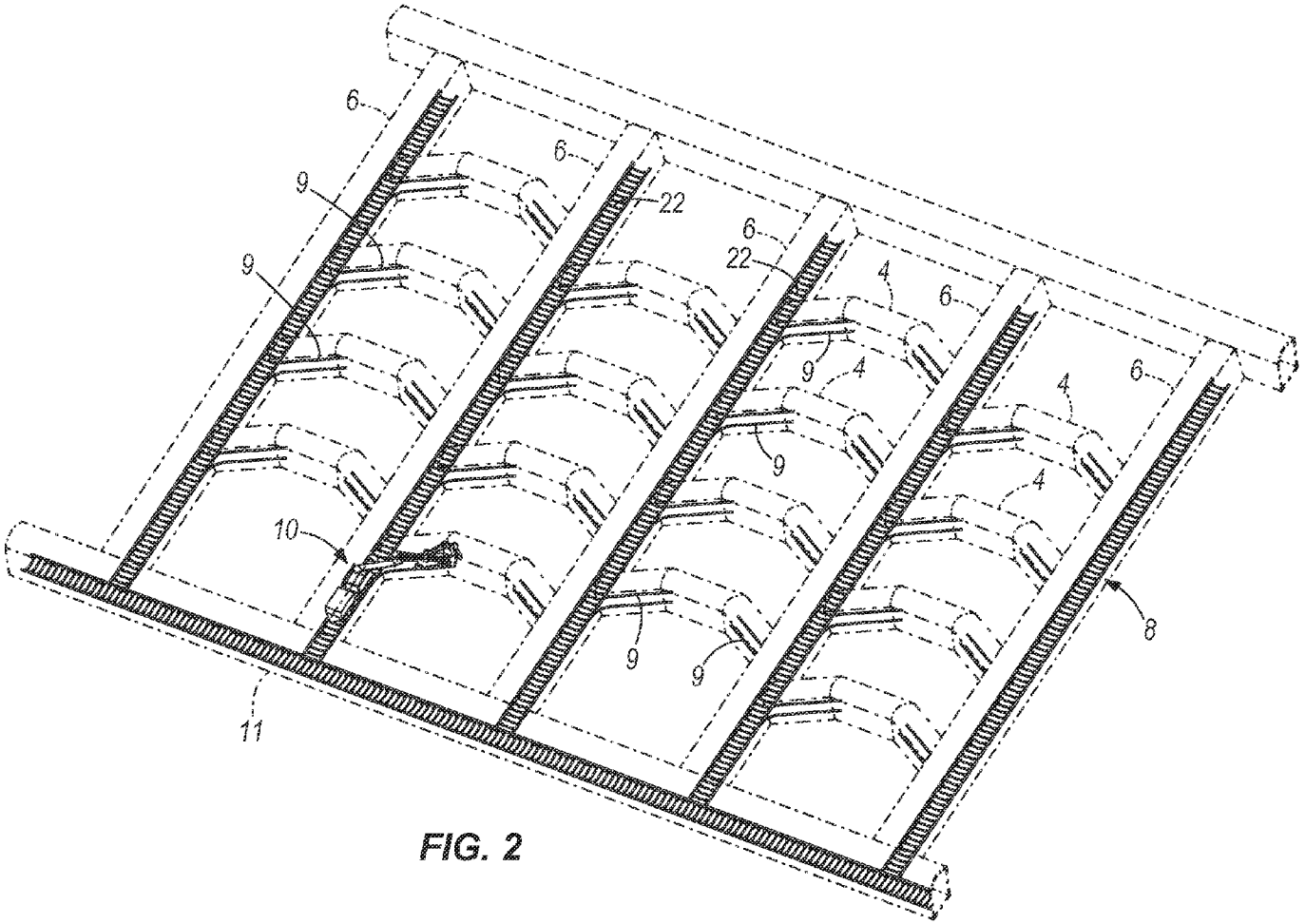
FIG. 2 is a top view of a first type of block-caving infrastructure with a chevron-type draw-bell layout, showing a first continuous-extraction system.

FIG. 1 illustrates a block-caving mining process, where fractured ore body 2, such as copper or gold ore, caves and falls by gravity toward a series of draw-bells 4. The draw-bells 4 are discharge points to roadway entries 6 that extend below the fractured ore body 2 and lead to other underground entries that permit material extracted from the draw-bells 4 to be transported to the surface. With reference also to FIG. 2, a block-caving infrastructure 8 typically includes a plurality of draw-bells 4 (e.g., sixteen, as shown) distributed through a mining block. The block-caving infrastructure 8 can be several hundred or several thousand meters underground. In the illustrated infrastructure 8, each draw-bell 4 is connected to adjacent roadway entries 6 by a pair of angled draw-bell entries 9. The draw-bell entries 9 leading to each draw bell 4 are oriented at an obtuse angle relative to the adjacent roadway entry 6 to form a chevron pattern, as can be seen in FIG. 2. This chevron pattern simplifies movement of mining equipment between the roadway entries 6 and the draw-bell entries 9, as discussed further below. Each roadway entry 6 leads to a transverse transport entry 11, which in turn leads to other entries that allow material removed from the draw-bells 4 to be transported to the surface.

Figure 3:
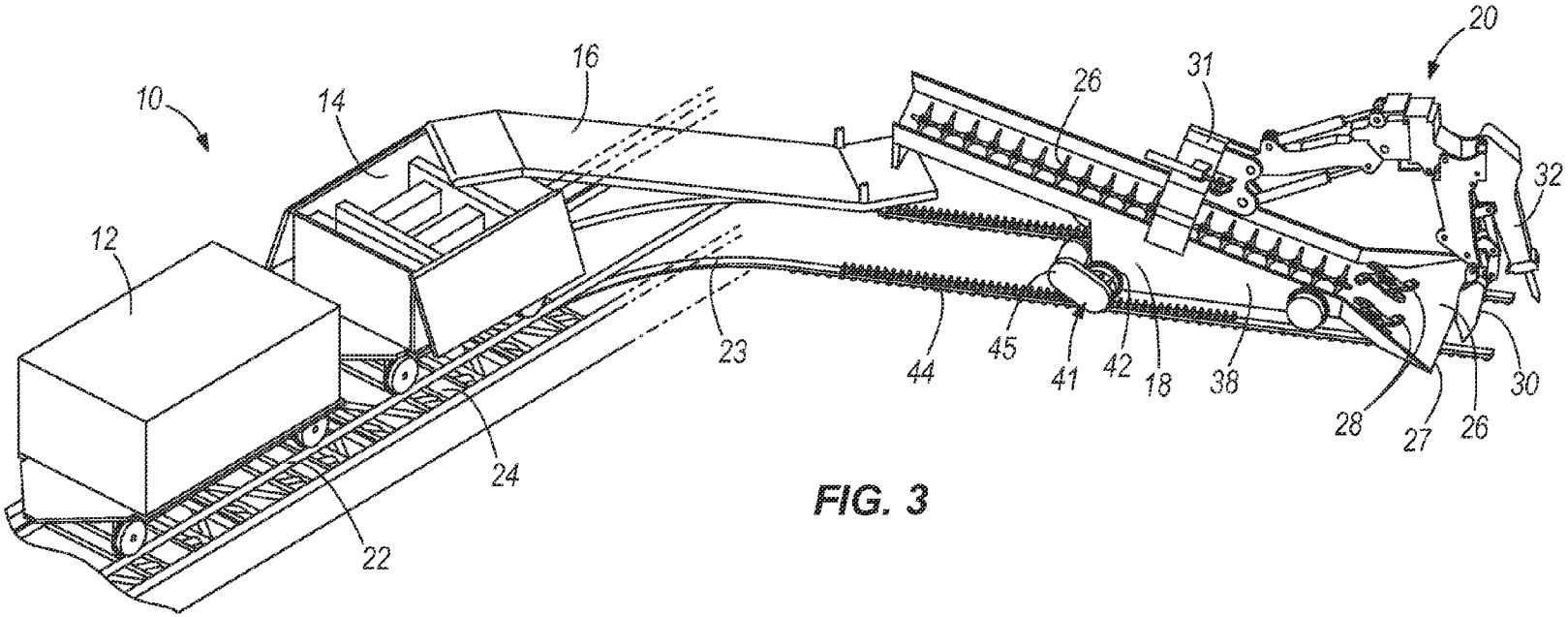
FIG. 3 is a top perspective view of the first continuous-extraction system shown in FIG. 2.
Figure 4:
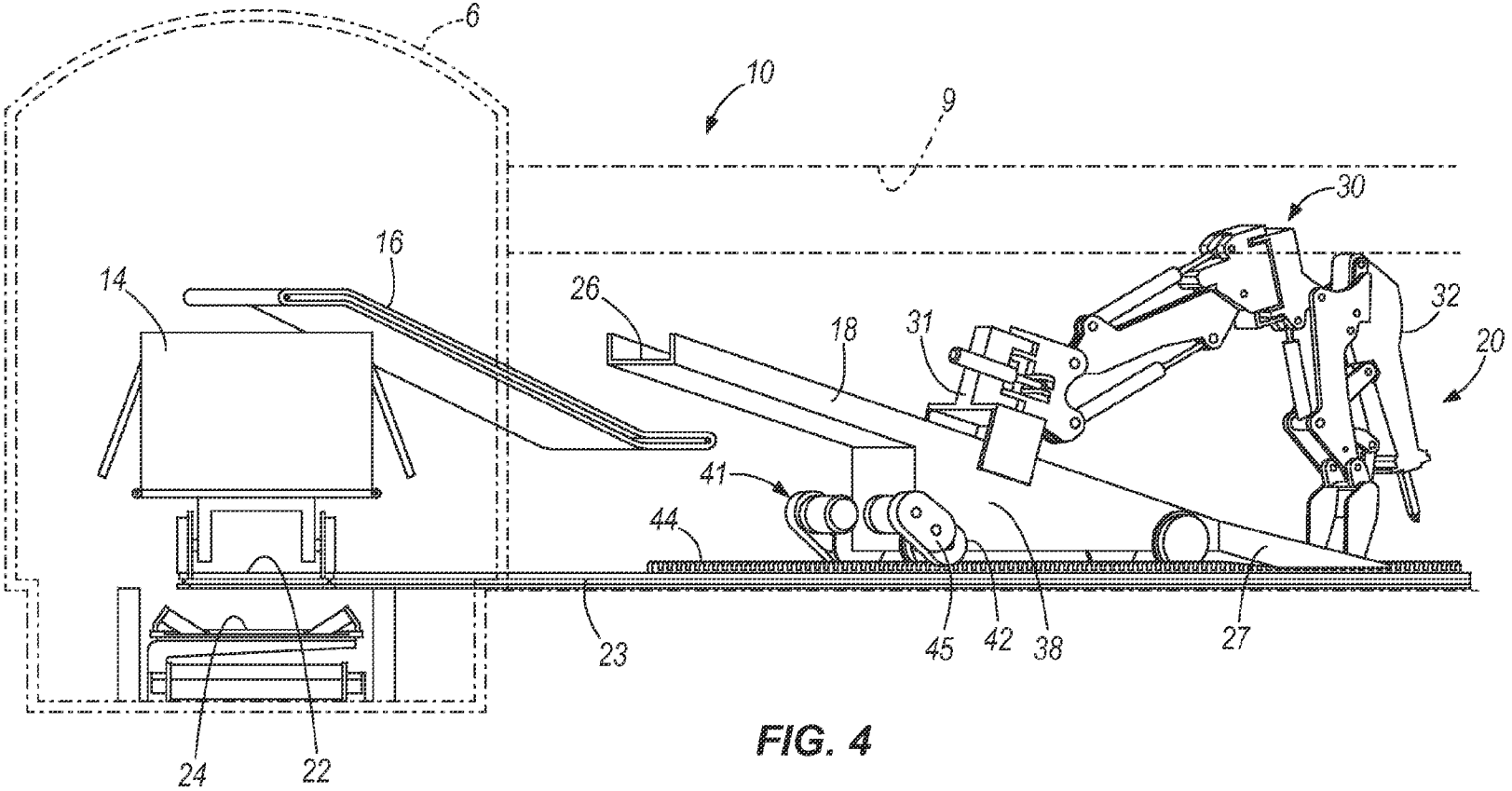
FIG. 4 is an elevational view of the first continuous-extraction system shown in FIG. 2.

Referring also to FIGS. 3-4, a continuous-extraction system 10 is moveable along the roadway entries 6 and into the draw-bell entries 9 for removing fractured ore 2 from the draw-bell 4. The continuous-extraction system 10 is an interconnected set of railcars and includes a primary drive and power center 12, a material collector in the form of a crusher or sizer 14, a bridge conveyor 16, and a loader or loading machine 18. The loading machine 18 is positioned at the front end 20 of the continuous-extraction system 10. The continuous-extraction system 10 can traverse fore and aft on track rails 22 that run through the block-cave infrastructure 8. As best shown in FIG. 4, the track rails 22 include an integrated conveyor system 24 positioned below the rails 22. The continuous-extraction system 10 thus runs on track rails 22, below which the conveyor system 24 runs in a substantially parallel manner. The conveyor system 24 can be a belt or chain-type conveyor. By way of example only, the figures depict a belt-type troughing conveyor.

As shown in FIG. 2, sets of track rails 22 extend along each of the roadway entries 6 and provide access to the draw-bells 4. At each draw-bell entry 6, a rail spur 23 diverges away from the track rails 22 and extends into the draw-bell entry 9. To access each draw-bell 4 from a given track rail 22, the continuous-extraction system 10 can make alternating left and right turns at obtuse angles into the draw-bell entries 9. In this regard, the continuous-extraction system 10 includes track switches (not shown) that allow the continuous-extraction system 10 to turn onto the rail spur 23 and advance into the draw bell-entry 9. The track switch can be mounted anywhere on the track rails 22.

In some embodiments, including those illustrated in FIGS. 3 and 4, the loading machine 18 advances into the draw-bell entry 9 while the power center 12 and crusher 14 remain on the track rails 22. General operation of the continuous-extraction system 10 is as follows—the loading machine 18 gathers material from the draw-bell 4 and deposits it onto the bridge conveyor 16, which extends rearwardly from the loading machine 18. The bridge conveyor 16 extends from the draw-bell entry 9 into the roadway entry 6 and transports ore 2 gathered from the draw-bell 4 by the loading machine 18 to the crusher 14.

The crusher 14 crushes the ore 2 to an acceptable size and discharges the crushed ore 2 onto the conveyor 24 that runs below the track rails 22. The conveyor 24 conveys the crushed ore to the transverse transport entry 11 (see FIG. 2) and out of the mine. The ore 2 thus continuously moves from the loading machine 18, to the bridge conveyor 16, to the crusher 14, to the conveyor 24, and then outside the mine.

Depending on the material being mined and the type of material preconditioning that is performed, some mining environments may not require the use of the crusher 14. In such instances, the crusher 14 can be replaced by a simplified material collector for receiving material from the loading machine 18 and depositing the material onto the conveyor 24 without further crushing or sizing of the material. Such a material collector may include intermediate conveyors or other powered material transport devices, or may include one or more funnels or chutes for guiding material received from the loading machine 18 onto the conveyor 24. Like the illustrated crusher 14, the material collector can be separate from the primary drive and power center 12 or, in some embodiments, the crusher 14 or the material collector can be integral with the primary drive and power center 12.

The continuous-extraction system 10 includes one or more drive mechanisms for tramming along the track rails 22 and the rail spurs 23. After completing an operation at a given draw-bell 4, the continuous-extraction system 10 can tram backwards until the loading machine 18 is once again positioned on the track rails 22. The continuous-extraction system 10 then advances to the next draw-bell 4 to repeat the ore-loading process. One or both of the primary drive and power center 12 and crusher 14 (if required) can include a suitable drive mechanism for moving the continuous-extraction system 10 along the track rails 22 and for pushing and pulling the loading machine 18 into and out of the rail spurs 23. In a block-cave infrastructure 8 with multiple draw-bells 4, a plurality of continuous-extraction systems 10 can be employed to improve production rates.

Figure 5:
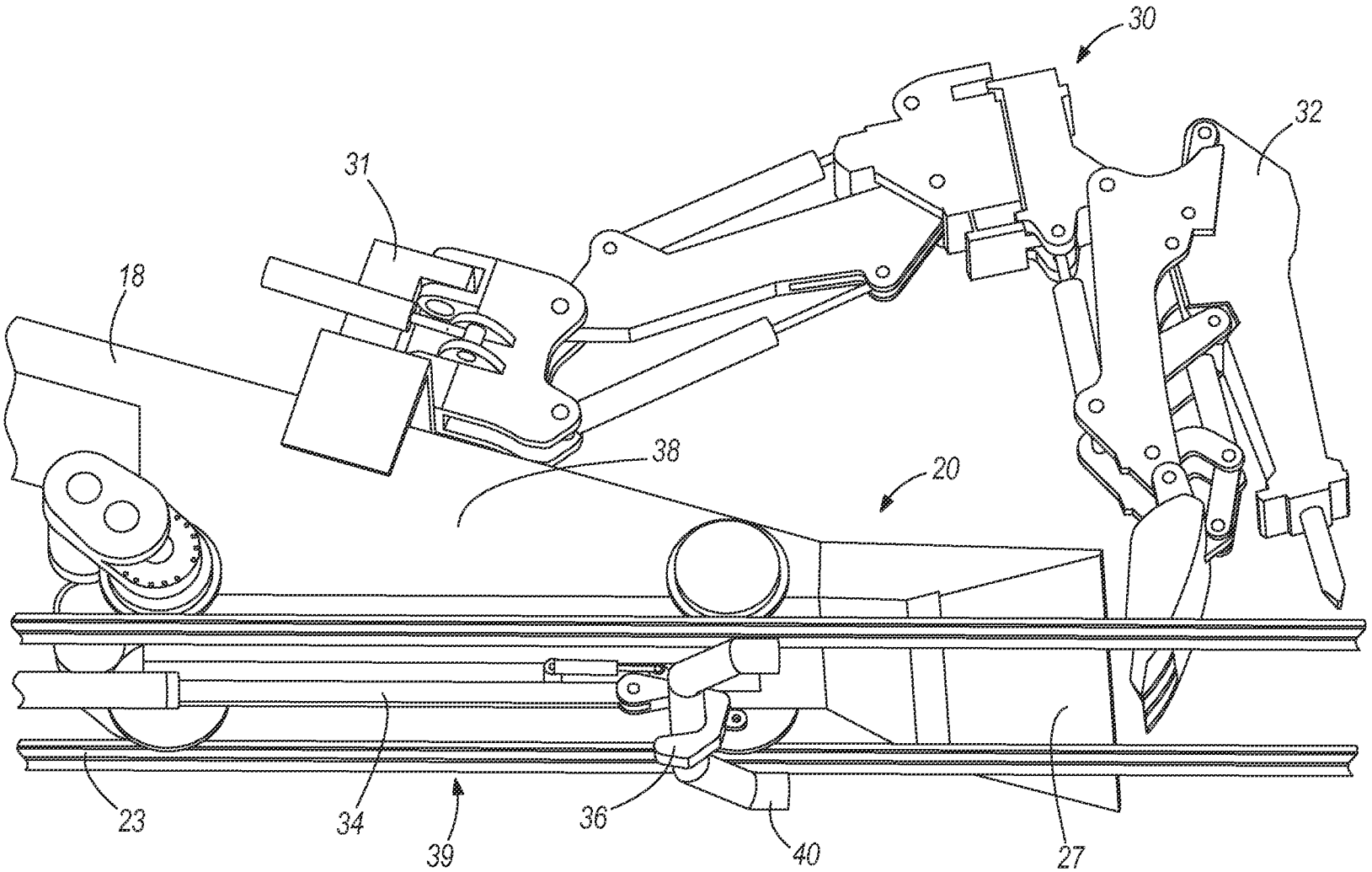
FIG. 5 is a bottom perspective view of a loader suitable for use with the first continuous-extraction system of FIG. 3.
Figure 6:
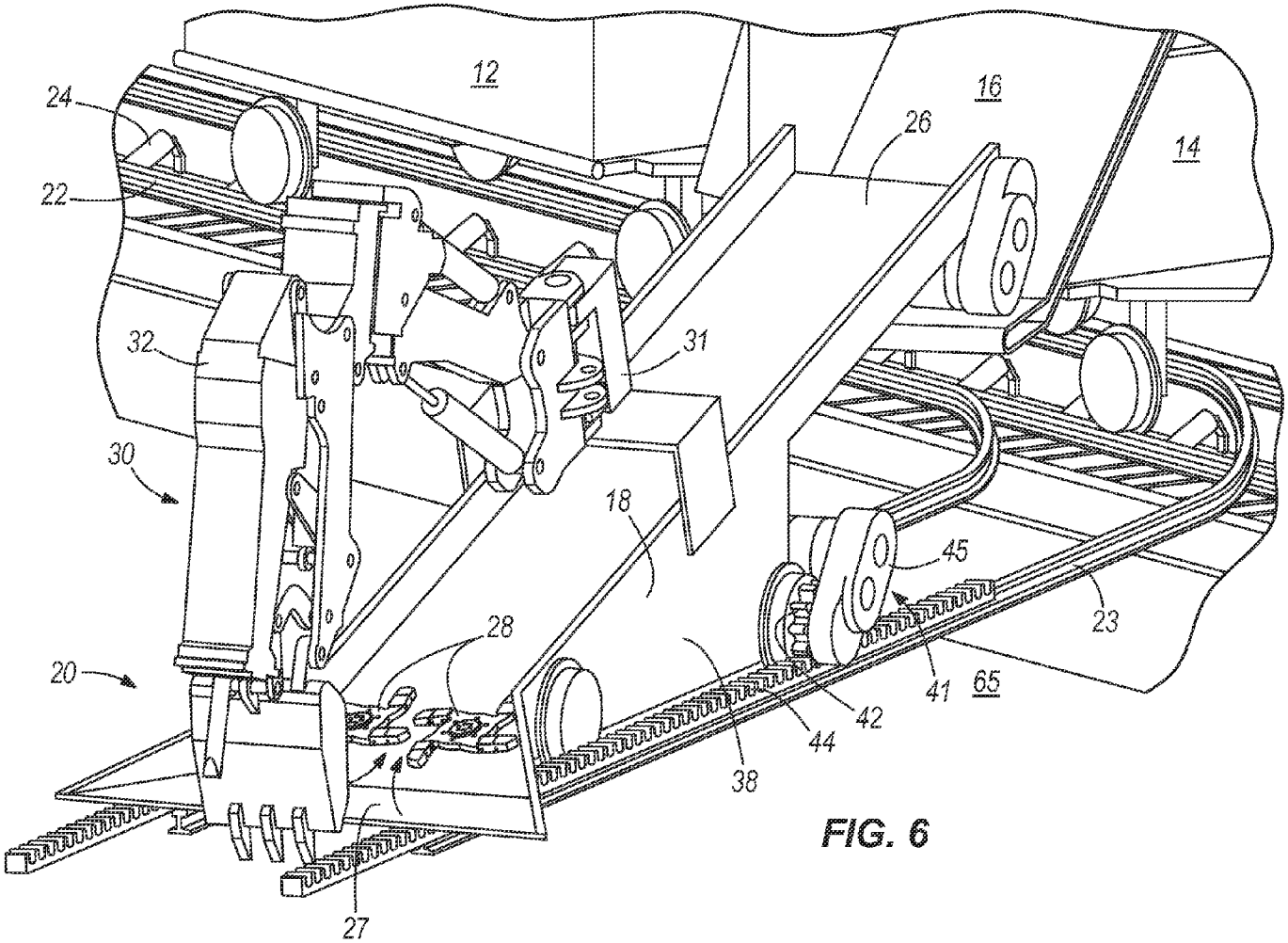
FIG. 6 is a top perspective view of an alternative embodiment of the loader of FIG. 5.

Referring also to FIGS. 5 and 6, the loading machine 18 includes a chassis 38 that rides along the track rails 22 and the rail spur 23. The chassis 38 is substantially wedge-shaped and includes a conveyor 26 extending from a front end to a rear end of the chassis 38. The front end of the chassis 38 also includes a collection tray 27 optionally including a pair of rotating collector wheels 28 that guide material onto the conveyor 26. The conveyor 26 receives the material removed from the draw bell 4, transports it rearwardly and upwardly, and deposits it onto the bridge conveyor 16.

The loading machine 18 also includes a carriage assembly 31 that is moveable in the fore and aft direction along the chassis 38 and has mounted thereto a backhoe-type loading arm 30. The loading arm 30 is operable to reach beyond the front end of the chassis into the draw-bell 4 and to move (e.g., to pull) material onto the collection tray 27. The illustrated loading arm 30 also includes a rock breaker 32 operable to break down large lumps of ore 2 that would be too large for the loading arm 30 to collect and maneuver onto the collection tray 27. In the illustrated embodiment, the rock breaker 32 is in the form of a jack hammer, but other embodiments may include other types of rock breakers such as drills, shearing type devices, and the like.

In operation, ore 2 is pulled from the draw-bell 4 by the backhoe-type loading arm 30, onto the collection tray 27 where the optional rotating collector wheels 28 help guide the material onto the conveyor 26. The conveyor 26 then conveys the material rearwardly and upwardly and deposits it onto the bridge conveyor 16. In the illustrated embodiments, both the conveyor 26 and the bridge conveyor 16 employ a plate-type conveyor.

Figure 7:
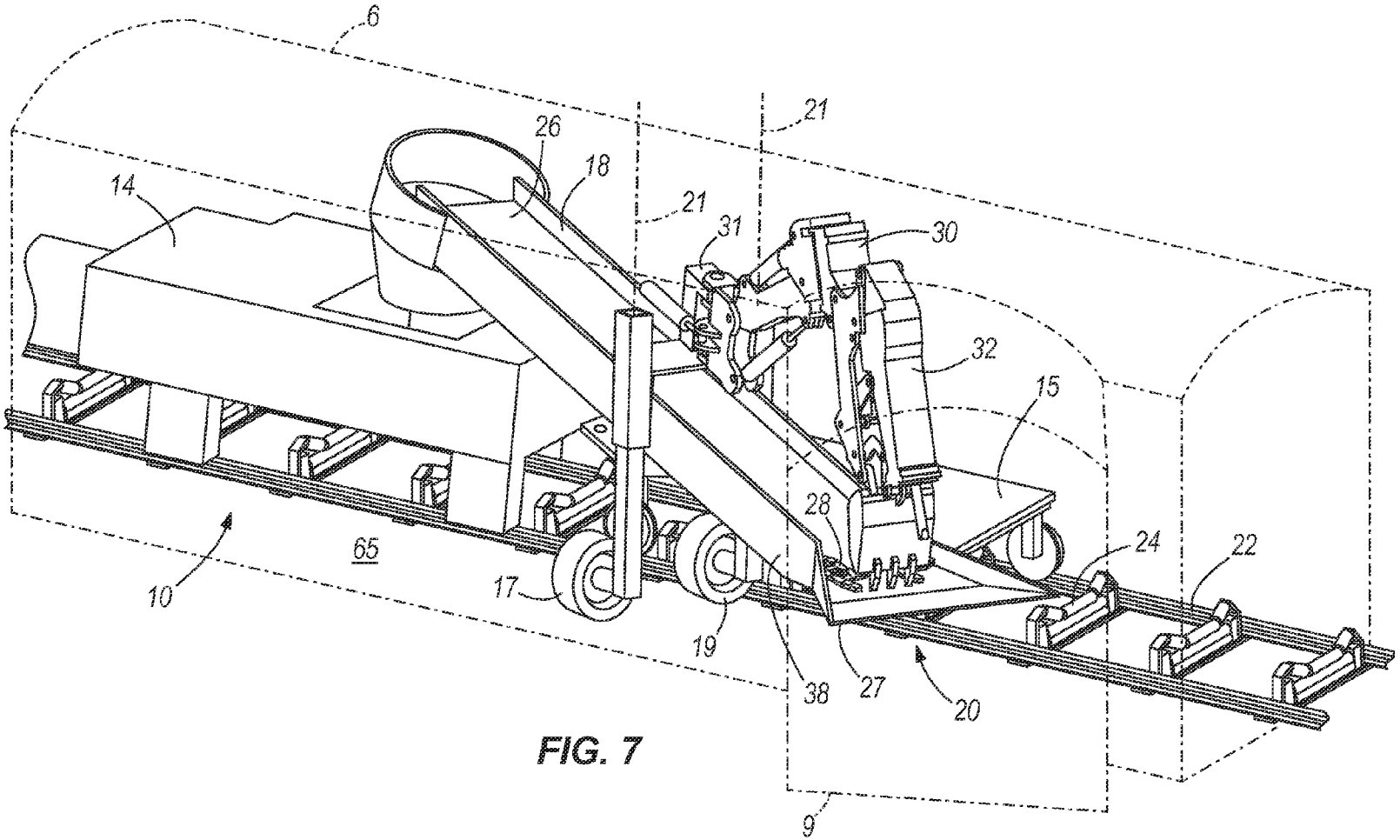
FIG. 7 is a perspective view of an alternative embodiment of the loader of FIGS. 5 and 6.

As shown in FIG. 7, some embodiments of the invention may include an alternative type of loading machine 18 that is able to move off of and onto a flatbed or "lowboy" rail car 15 positioned on the track rails 22. In such embodiments, instead of rail-car-type wheels for movement over rails, the loading machine 18 includes treads or wheels 17, 19 (wheels are shown in FIG. 7) for movement over the mine floor. As such, the rail spurs 23 that extend into the draw-bell entries 9 can be eliminated. The alternative loading machine 18 includes sets of transfer members in the form of the wheels 17, 19 that are operable to move the front end 20 of the loading machine 18 toward the draw-bell entry 9. The transfer wheels 17, 19 are rotatable about a generally vertical axis 21 for movement in a variety of directions. The transfer wheels 17, 19 also are vertically moveable relative to the chassis 38 of the loading machine 18 and are able to "step off" of the lowboy rail car 15 and engage the mine floor 65. For example, the transfer wheels 17, 19 move the loading machine 18 sideways until the first transfer wheel 17 is off the lowboy rail car 15 while the other transfer wheel 19 remains on the lowboy rail car 15. The first transfer wheel 17 is then moved downwardly until it engages the mine floor 65, and both transfer wheels 17, 19 then operate to move the loading machine 18 generally laterally until the second transfer wheel 19 is positioned off of the lowboy rail car 15 and can be lowered onto the mine floor 65. Once all of the transfer wheels 17, 19 are positioned on the mine floor 65, the transfer wheels 17, 19 lower the chassis 38 toward the mine floor 65 and then rotate about the axes 21 for movement in a generally forward direction into the draw-bell entry 9. In alternative embodiments the loading machine 18 may include a separate set of fixed wheels configured for forward movement into the draw-bell entry 9. In such embodiments, the transfer wheels 17, 19 can be moved vertically upwardly a sufficient amount to remain out of the way while the fixed wheels maneuver the loading machine 18 to collect material from the draw-bell 4. The operation is performed in reverse to return the loading machine 18 to the lowboy rail car 15.

Referring back to FIG. 5, a first crowding mechanism 39 that helps the loading machine 18 gather material from the draw-bell 4 is illustrated. The crowding mechanism 39 is an optional feature that can help urge the loading machine 18 and the rest of the continuous-extraction system 10 closer to the draw-bell 4, thereby making it easier for the loading arm 30 to maneuver ore 2 onto the collection tray 27 and enhancing the loading operation. The crowding mechanism 39 of FIG. 5 includes a telescoping hydraulic cylinder 34 coupled to the chassis 38 of the loading machine 18 and a movable portion in the form of a hook 36 positioned on an end of the hydraulic cylinder 34. The hook 36 is configured to engage a fixed member in the form of a bar 40 that is fixed relative to the mine floor 65 at a location within the draw-bell entry 9. In other constructions, the bar 40 could instead be positioned in the roadway entry 6. In the illustrated embodiment, the bar 40 is coupled to a portion of the rail spur 23. In other embodiments, the bar 40 is anchored to the mine floor 65. In operation, the hook 36 engages the bar 40 and the hydraulic cylinder 34 is actuated to pull or push (depending on the specific configuration and location of the hook 36 relative to the loading machine 18) the loading machine 18 toward the draw-bell 4. As the loading machine 18 moves toward the draw-bell 4, some ore 2 may be pushed onto the collection tray 27 without requiring use of the loading arm 30. Once the loading machine 18 has been advanced as far into the draw-bell 4 as possible, the loading arm 30 can then be used to maneuver additional ore 2 onto the collection tray 27.

FIG. 6 illustrates a second crowding mechanism 41 that can be an alternative or a supplement to the first crowding mechanism 39 of FIG. 5. The second crowding mechanism 41 includes a movable portion in the form of a pinion 42 coupled to the loading machine 18 and a fixed portion in the form of a rack 44 that is fixed relative to the mine floor 65 and that is engaged by the pinion 42. The rack 44 can be anchored directly to the mine floor 65 or can be mounted on a portion of the rail spur 23. The pinion 42 is coupled to a drive mechanism 45 that is operable to drive the pinion 42. In some embodiments, the pinion 42 is driven by the same drive mechanism that drives the wheels of the loading machine 18. When the pinion 42 is driven while engaged with the rack 44, the pinion 42 urges the loading machine 18 toward the draw-bell 4. While FIG. 6 shows the pinion 42 coupled to a rear wheel of the loading machine 18, in other embodiments the pinion 42 can be separate from the wheels or coupled to more and/or other wheels of the loading machine 18, such as the front wheels, rear wheels, or combinations thereof.

Figure 8:
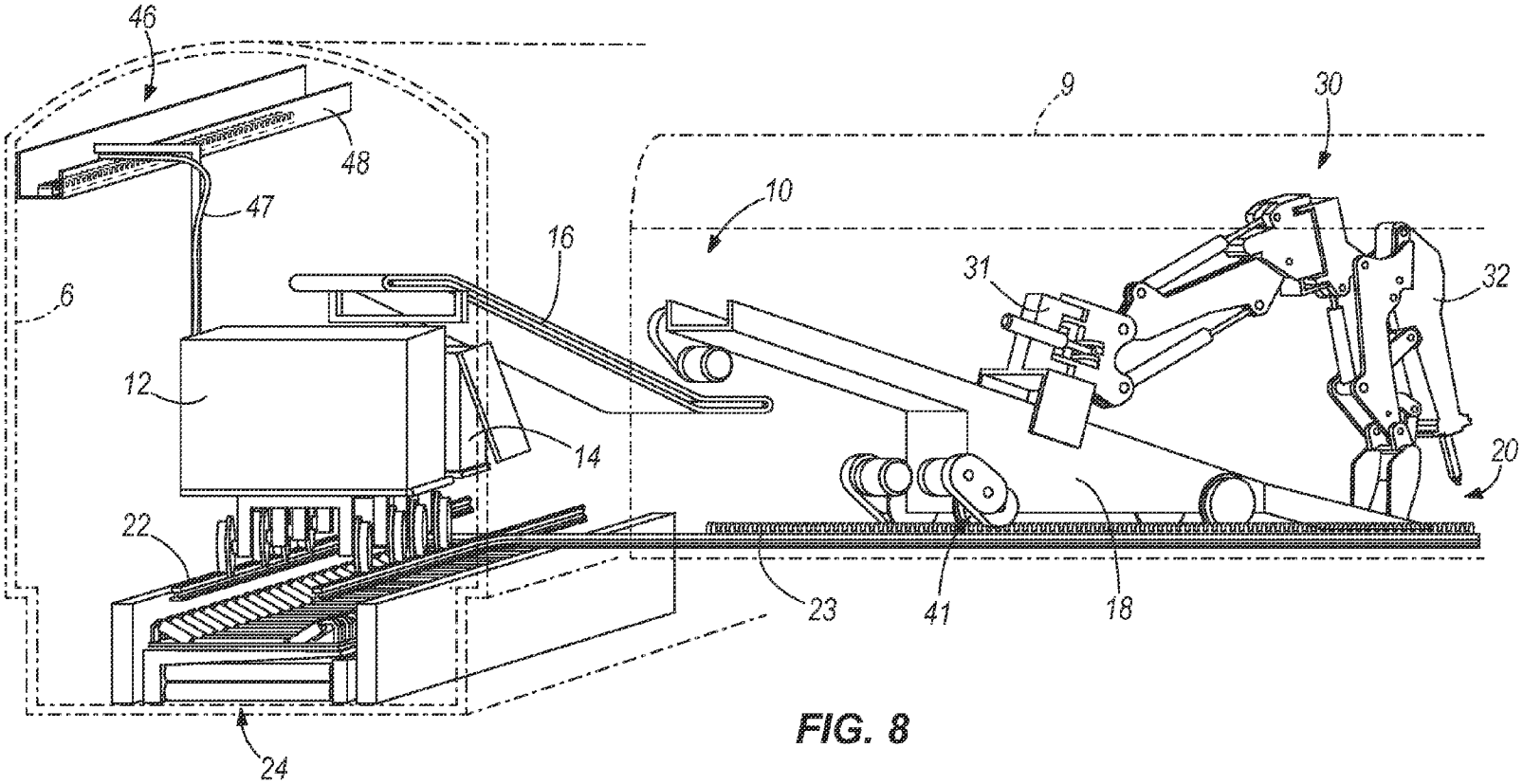
FIG. 8 is a rear perspective view of the continuous-extraction system of FIG. 3, showing a cable-handling system for powering the continuous-extraction system.

Referring to FIG. 8, in some embodiments, the continuous-extraction system 10 is powered by overhead cables that are enclosed within a Bretby-type cable handling system 46. The Bretby-type cable handling system 46 is a flexible carrier consisting of a series of flat plates. The plates are paired, one forming a bottom and the other a top, and the sides are connected by pins. The top and bottom plates and the side pins encase an area where cables can be handled. Each pair of plates is then connected to an adjacent pair of plates, forming a chain that resembles continuous tracks on heavy equipment. Power cables 47 can drop down from an overhead cable trough 48 to the power center 12. The power center 12 is typically the last car of the continuous-extraction system 10 and powers elements of the continuous-extraction system 10, such as the crusher 14, conveyor 16, loading machine 18, and various controls associated therewith. In other embodiments, a monorail overhead with trolleys can be used in place of the Bretby-type cable handling system 46.

In other embodiments, the continuous-extraction system 10 is powered by electrical plug-in stations at each draw-bell 4. The continuous-extraction system 10 can be equipped with cable reels that reel in and pay out cables that connect to nearby plug-in stations along the roadway entry 6 and supply power to the system 10. In operation, an onboard operator initially plugs in the electrical cable to a proximal plug-in station, thus powering the system 10 through a cable from the proximal plug-in station. As the system 10 moves from a proximal plug-in station to a distal plug-in station, the onboard operator can plug another electrical cable to the distal plug-in station. The operator or system then reconfigures the internal power management system so that the system 10 is powered through cables from the distal plug-in station. After the internal power management has been reconfigured, the operator can unplug the cable to the proximal plug-in station. This way, each cable does not run the entire length between plug-in stations, and therefore in some embodiments the length of cable needed on the reels can be minimized. The plug-in stations can be disposed on the floor or wall of the mine at each draw-bell 4 or mounted on a supporting structure.

In still other embodiments, the continuous-extraction system 10 includes a self-contained power supply for moving from one draw-bell 4 to another after being disconnected from an external source of power, such as the Bretby-type cable handling system 46 discussed above. In some embodiments, the continuous-extraction system 10 is powered through batteries, a small diesel power unit, or a hybrid unit. The system 10 can be powered for example through multiple batteries, where one or more batteries are being charged while the others are being used. In some embodiments, the system 10 can be powered by a hybrid of diesel engine and batteries, where a diesel engine runs to charge the battery, for example between high load demands, between shifts, at break times, and the like. The batteries, small diesel power unit, or hybrid unit can be used to drive electric and/or electro-hydraulic motors and drive systems. Because it remains substantially stationary, the conveyor system 24 that runs through the block-cave infrastructure 8 can be powered from stationary power centers that are independent from the overhead power cables or other power sources associated with the continuous-extraction system 10.

Some embodiments can also include automation equipment operable to position the continuous-extraction system 10 at draw-bells 4 and to control other movements as needed. For example, remote cameras can be employed to help operate the backhoe-type loading arm 30 and maneuver and operate the continuous-extraction system 10 into the draw-bell 4 from a remote location. Radio or cable communication links can be used to a similar extent, with or without the remote operation cameras. In some embodiments, an operator for the remote operation cameras, communication links, or both, can be located underground. In other embodiments, the operator can be located above ground. An above ground operator can be many kilometers away from the mine. In yet other embodiments, the continuous-extraction system 10 can contain position-sensing devices for automation, remote operation, or both.

Figure 9:
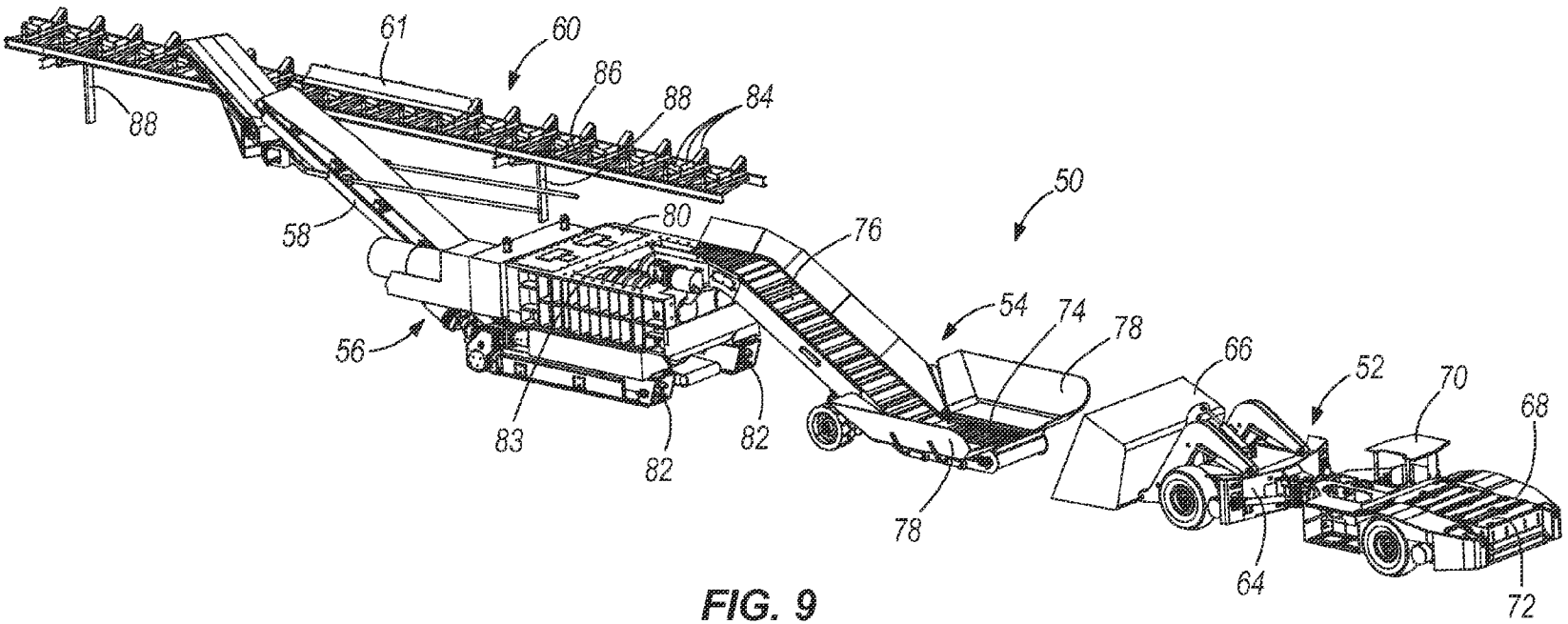
FIG. 9 is a perspective view of a second continuous-extraction system including a feeder, a material collector, and a bridge conveyor that feed material to an elevated and cantilevered haulage conveyor.
Figure 10:
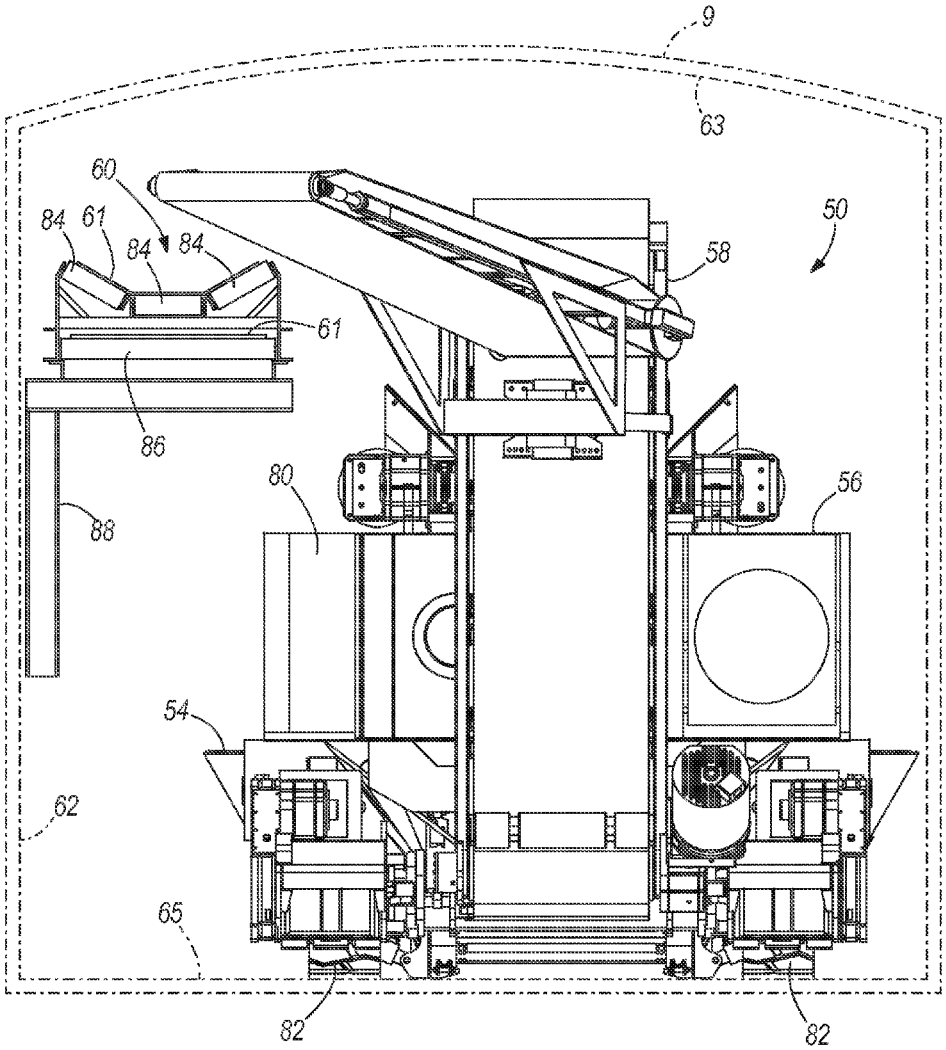
FIG. 10 is an end view of the continuous-extraction system of FIG. 9.

FIGS. 9 and 10 illustrate an alternative form of a continuous-extraction system 50. The continuous-extraction system 50 includes a loader in the form of a load-haul-dump machine ("LHD") 52, a feeder 54, a combined power center and material collector in the form of a mobile crusher 56, a bridge conveyor 58, and an elevated and cantilevered haulage conveyor 60. Unlike the continuous-extraction system 10 described above, which includes tracks 22 and a conveyor 24 that occupy the mine floor 65, the continuous-extraction system 50 utilizes a haulage conveyor 60 that is elevated above the mine floor 65 and cantilevered from one of the walls 62 of the roadway entry 6 (see FIG. 10). This configuration allows for substantially unrestricted access to all areas of the block-caving infrastructure 8 because the mine floor 65 remains unobstructed. By having the mobile crusher 56 positioned within the roadway entry 6 proximal to the draw-bell 4 from which the LHD 52 is extracting ore 2, the amount of time spent tramming by the LHD 52 is dramatically reduced compared to known systems that utilize massive, centrally-located underground dump points with large, immovable crusher assemblies.

Although various configurations are possible, the illustrated LHD 52 includes a front end 64 with a moveable load bucket 66 operable to collect, carry, and dump ore 2. The front end 64 is pivotally coupled to a rear end 68 of the LHD 52. The pivotal coupling allows the LHD 52 to be articulated in two parts and helps negotiate curves. The rear end 68 includes an operator cab 70 and an integrated drive mechanism and power source 72. Like the loading machine 18, the LHD 52 can include a rock breaker such as a jack hammer on the front end 64 to break down large lumps of ore 2 that would otherwise be too large for the bucket 66 to collect. Although FIG. 8 illustrates a single moveable load bucket 66 on the front end 64 of the LHD 52, other LHD 52 embodiments can include a bucket 66 on both the front end 64 and the rear end 68, with the operator cab 70 and the power source 72 interposed between the two buckets 66. The LHD 52 may also be configured for remote operation, thereby eliminating the need for the operator cab 70.

The drive mechanism and power source 72 may be electrical or electro-hydraulic, and may be powered by batteries or by an external power source. In some embodiments, each wheel of the LHD 52 may include its own dedicated electronic drive that comprises, for example, an electric motor and accompanying gearbox. In this way, each wheel can be controlled independently by an associated variable frequency drive system or a chopper drive system, thus reducing or eliminating the need for mechanical transfer cases and differentials. Where external power is used, the LHD 52 is provided with a suitable cable handling system. Because of the mobile crusher 56, the LHD 52 is only required to tram the relatively short distance between the draw-bells 4 and the mobile crusher 56, which enables the use of batteries as a means of powering the LHD 52. In the illustrated construction, the power source 72 at the rear end 68 of the LHD 52 is made up of a battery tray. Alternatively, the LHD 52 may be powered by a diesel engine. In some embodiments, the LHD 52 is driven or powered at least in part by a "drop-in" diesel-electric power pack or similar generator set that includes an internal combustion engine coupled to a generator or other suitable device for producing electrical power from the work performed by the engine. Such a generator set may supplement an otherwise primarily electrical drive mechanism and power source and may be capable of driving and powering all operations of the continuous miner without the need for external power.

With continuing reference to FIG. 9, feeder 54 includes a gather portion 74 where it receives ore 2 from the LHD 52, and a conveyor portion 76 where it transports the ore 2 to the mobile crusher 56. The gather portion 74 includes wings 78 that are attached to the left and right sides of the feeder 54 and guide the ore 2 to the conveyor portion 76. In some embodiments, the wings 78 are pivotally attached to the gather portion 74 and can fold up as the ore 2 is transported to the mobile crusher 56. The foldable wings 78 can help guide and feed the ore 2 to the conveyor portion 76. The conveyor portion 76 of the feeder 54 can employ a plate-type conveyor, an armored-face conveyor, or other conveyors that are known in the art. In some constructions, the feeder 54 is driven by its own integrated drive system (not shown). Other constructions of the feeder 54 can be towed by mobile crusher 56. Although FIG. 9 illustrates a single feeder 54 transporting the ore 2 to the mobile crusher 56, in other embodiments more than one feeder 54 can transport the ore 2 to the mobile crusher 56, for example from opposing sides of the mobile crusher 56.

With continuing reference to FIGS. 9 and 10, mobile crusher 56 or sizer is operable to crush or size the material and deposit the material onto the bridge conveyor 58. The crusher 56 includes a crusher portion 80 that is mounted on drive treads 82. One or more cylindrical rollers 83 with associated bits are mounted in the crusher portion 80 and crush or size the ore 2. The crusher 56 is moveable along the mine floor 65 and can be positioned anywhere along the length of the haulage conveyor 60. Although FIG. 9 illustrates the mobile crusher 56 with drive treads 82, other embodiments can include track-type crawlers, rubber-tired wheels, or substantially any other type of support that allows for movement of the crusher 56. In some embodiments, movement of the mobile crusher 56 is controlled by an automated system using inertial or other types of navigation or guidance, such that the mobile crusher 56 is automatically advanced along roadway entry 6 in sequence with movement of the LHD 52. The mobile crusher 56 is operatively driven by a primary drive and power center that may be or include electrical, electro hydraulic, or a combination of electric and hydraulic motors, and in some embodiments may be powered at least in part by diesel power. As discussed above, depending on the mining environment in which the system 50 is deployed, material extracted from the draw-bells 4 may be such that a crusher or sizer is not required. In such cases, the crusher portion 80 can be replaced by a somewhat simplified material collector that may include intermediate conveyors, funnels and/or chutes for collecting material received from the LHD 52 and transferring it to the bridge conveyor 58.

With continuing reference to FIGS. 9 and 10, bridge conveyor 58 extends generally upwardly toward the roof 63 of the roadway entry 6 from a location proximal to the floor 65. The bridge conveyor 58 upwardly conveys material received from the mobile crusher 56 and deposits the material onto the haulage conveyor 60. The bridge conveyor 58 can contain portions with different slopes. Some embodiments of the bridge conveyor 58 may also include support legs. The bridge conveyor 58 may be separate from or integral with the mobile crusher 56, and may be driven or powered by its own independent drive system or by the drive system of the crusher 56. The bridge conveyor 58 is therefore moveable along the mine floor 65 and can be positioned anywhere along the length of the haulage conveyor 60. In the illustrated construction, the bridge conveyor 58 is based on an endless belt-type conveyor; however, other conveyor types may also be used. In some constructions, the bridge conveyor 58 is pivotable with respect to the mobile crusher 56 or is otherwise adjustable to the right or left to accommodate different mine configurations.

With continuing reference to FIGS. 9 and 10, the elevated and cantilevered haulage conveyor 60 is positioned proximal to the roof 63 and coupled to one of the sidewalls 62 of the roadway entry 6 in a cantilevered manner. In some embodiments, the haulage conveyor 60 is supported solely by the wall 62. In further embodiments, the haulage conveyor 60 is positioned at least half way up the wall 62 between the roof 63 and the floor 65. In other embodiments, the haulage conveyor 60 is positioned at least two-thirds of the way up the wall 62 between the roof 63 and the floor 65. In further embodiments, the roadway entry 6 includes a centerline, and the entire haulage conveyor 60 is positioned to one side of the centerline. Stated slightly differently, the haulage conveyor 60 is off-center when viewed in the longitudinal direction of the roadway entry 6.

The illustrated haulage conveyor 60 is a trough conveyor and includes a set of trough rollers 84 that support the conveying run of the conveyor belt 61, and a set of lower rollers 86 that support the return run of the conveyor belt 61. The haulage conveyor 60 is supported by a plurality of L-brackets 88. Each L-bracket 88 has a substantially vertical leg that is coupled to the mine wall 62, and a substantially horizontal leg that extends beneath and supports the haulage conveyor 60. Because the haulage conveyor 60 is elevated from the mine floor 65, the presence of undulations or other deformation of the mine floor 65 does not hinder performance of the conveyor 60. The elevated and cantilevered haulage conveyor 60 receives crushed ore from the bridge conveyor 58 and conveys the crushed ore to the transverse transport entry 11 (see FIG. 2) and out of the mine.

Figure 11:
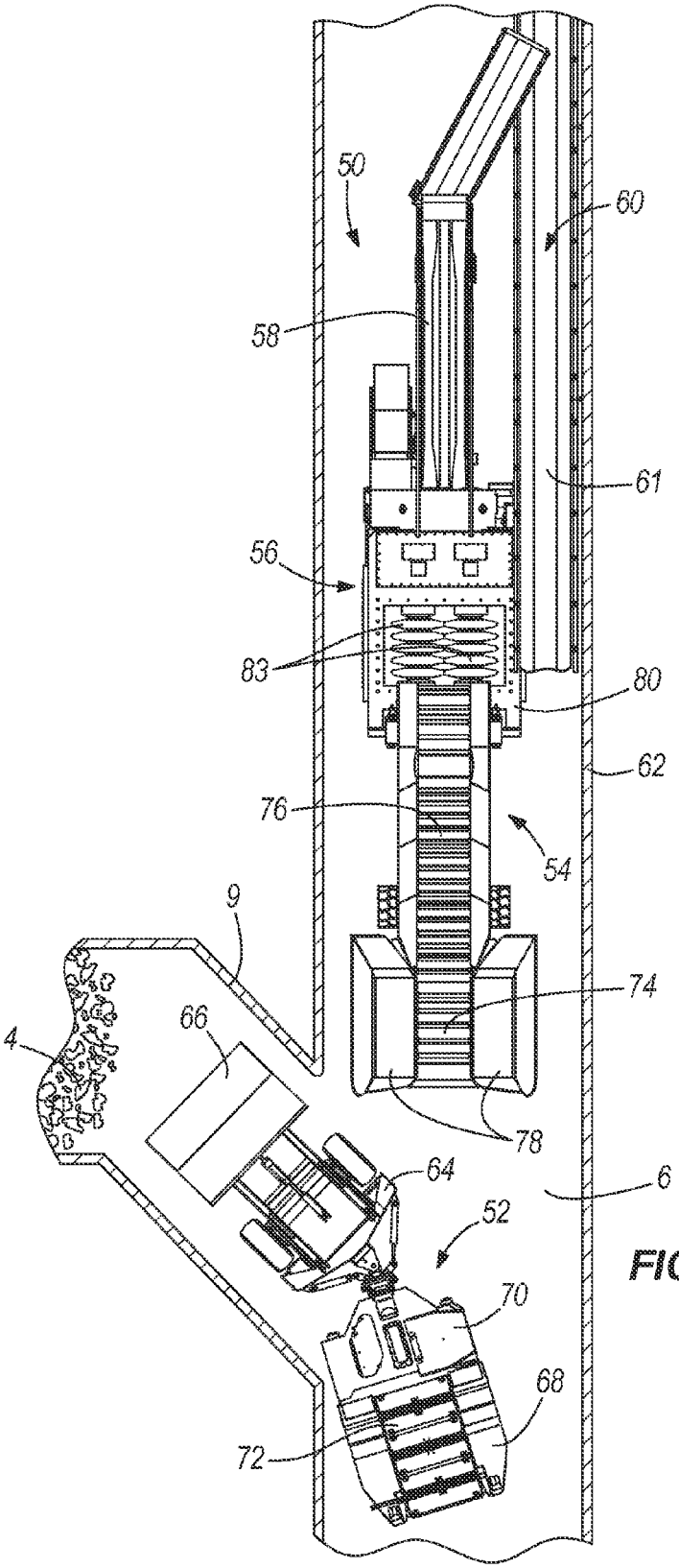
FIG. 11 is a top view of the continuous-extraction system of FIG. 9.

Referring to FIG. 11, in operation, the LHD 52 moves into the draw-bell 4 via the draw-bell entry 9 to collect ore 2 with the moveable load bucket 66. To this end, the bucket 66 is first crowded into the draw-bell 4 and then pivotably swung about a transverse axis. As the bucket 66 is loaded, the LHD 52 trams backwards until the LHD 52 is once again positioned on the roadway entry 6. The LHD 52 then advances to the feeder 54, which is positioned in the roadway entry 6 beyond the draw-bell entry 9, and the LHD 52 dumps the ore 2 from the load bucket 66 into the gather portion 74 of the feeder 54. The feeder 54 moves the ore 2 from the gather portion 74 to the conveyor portion 76, and the conveyor portion 76 drops the ore into the crusher 56. The crusher 56 crushes or sizes the ore 2 (if necessary), and deposits the ore onto the bridge conveyor 58. The bridge conveyor 58 transports the crushed ore upwardly and away from the crusher 56 to the elevated haulage conveyor 60. The haulage conveyor 60 then transports the crushed ore to the transverse transport entry 11 (see FIG. 2), where it is subsequently carried away and out of the mine. After dumping the ore 2 in the feeder 54, the LHD 52 trams backwardly along the roadway entry 6 beyond the draw-bell entry 9, and then trams forwardly and turns into the draw-bell entry 9 to return to the draw-bell 4 for removal of additional material. The LHD 52 then repeats the ore-loading process. When the LHD 52 finishes collecting material from one draw-bell 4, the continuous-extraction system 50 moves along the roadway 6 to the next draw-bell entry 9. Specifically, the feeder 54, the mobile crusher 56, and the bridge conveyor 58 of the continuous-extraction system 50 tram beyond the next draw-bell entry 9, and thereby provide the LHD 52 with access to the next draw-bell 4. In a block-cave infrastructure 8 with multiple draw-bells 4, a plurality of continuous-extraction systems 50 can be employed to improve production rates.

Figure 12:
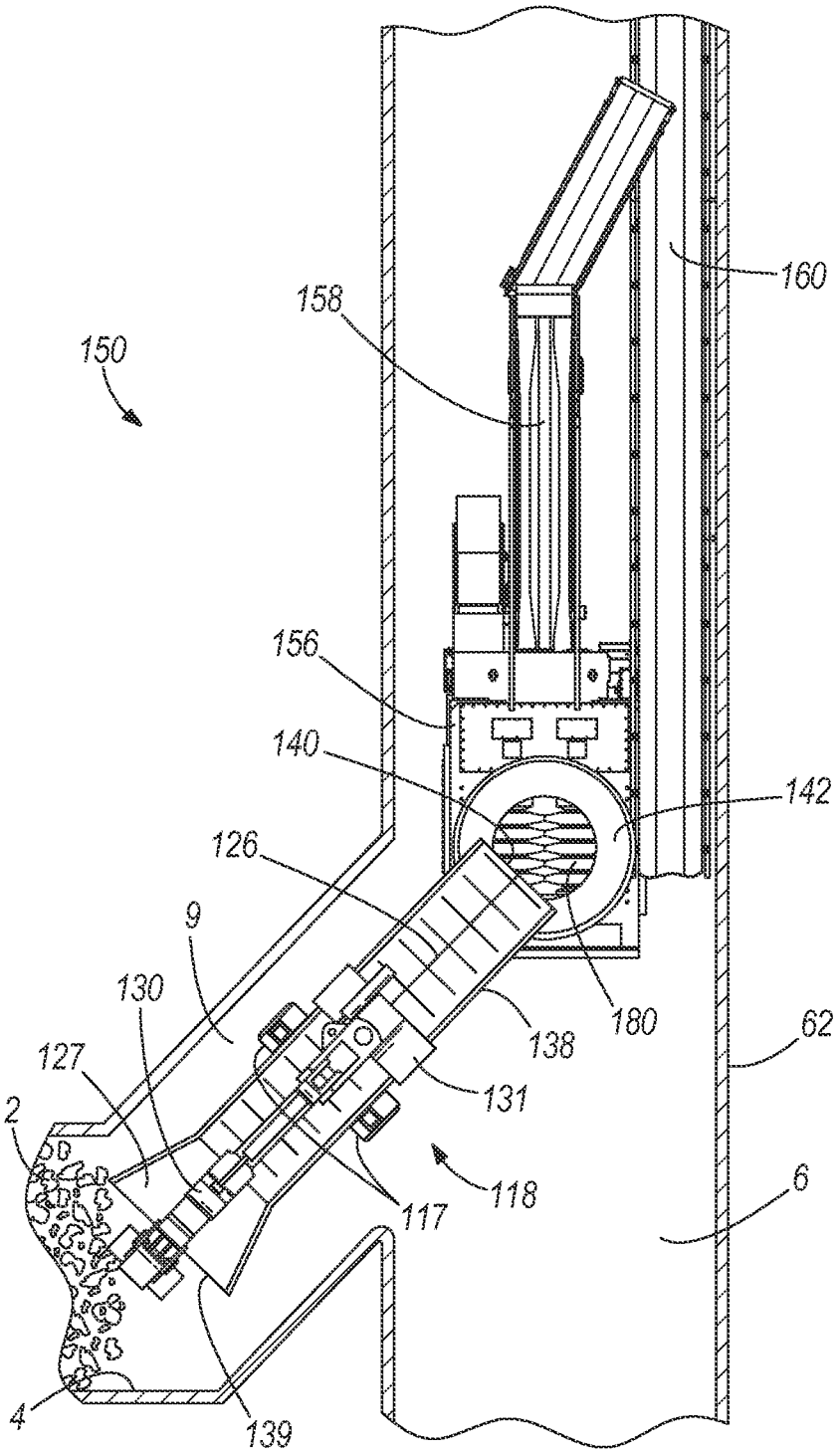
FIG. 12 is a top view of an alternative continuous-extraction system.

FIG. 12 illustrates a modified version of the continuous-extraction system 50 shown in FIG. 11 whereby the LHD 52 is replaced with a loader in the form of a loading machine 118 similar to the loading machine 18 illustrated in FIG. 7. The continuous-extraction system 150 of FIG. 12 includes a crawler-mounted or wheel-mounted material collector 156, which may include a crusher portion 180, as illustrated. The system 150 also includes a bridge conveyor 158 that carries material from the material collector 156 upwardly to an elevated and cantilevered haulage conveyor 160 that is cantilevered from the sidewall 62 of the roadway entry 6. Although the illustrated construction does not include a feeder, a feeder similar to the feeder 54 discussed above may also be included in the continuous-extraction system 150.

The loading machine 118 includes a chassis 138 including a conveyor 126 extending from a collection end 139 to a discharge end 140 of the chassis 138. The collection end 139 of the chassis 138 also includes a collection tray 127 optionally including a pair of rotating collector wheels (not shown) that guide material onto the conveyor 126. The loading machine 118 also includes a carriage assembly 131 that is moveable in the fore and aft direction along the chassis 138 and has mounted thereto a backhoe-type loading arm 130. The loading arm 130 is operable to reach beyond the front end of the chassis into the draw-bell 4 and to move (e.g., to pull) material onto the collection tray 127. The loading arm 130 can also include a rock breaker (not shown but similar to the rock breaker 32 of FIGS. 3-8) operable to break down large lumps of ore 2 that would be too large for the loading arm 130 to collect and maneuver onto the collection tray 127. The loading machine 118 also includes steerable treads or wheels 117 (wheels are shown in FIG. 12) for movement over the mine floor. The wheels 117 are rotatable about a generally vertical axis for movement in a variety of directions, and are also vertically moveable relative to the chassis 138 of the loading machine 118 for raising and lowering the chassis relative to the mine floor 65.

The discharge end 140 is pivotally coupled to the material collector 156 and may include a funnel or other guide member 142 for guiding material from the conveyor 126 into the crusher section 180. The pivotal coupling between the discharge end 140 and the material collector 156 allows the loading machine 118 to be pushed or pulled by the material collector 156 for movement into and out of the draw-bell entries 9 and for movement along the roadway entries 6. In operation, the wheels or treads of the material collector 156 are operated to move the material collector 156 and the loading machine 118 in the fore and aft direction. The wheels 117 of the loading machine 118 are then steered as needed to guide the loading machine into and out of the draw-bell entries 9. When the collection end 139 of the loading machine 118 is positioned adjacent the draw bell 4, the loading arm 130 pulls material onto the collecting tray 127 and the material is then conveyed rearwardly by the conveyor 126 and dropped into the material collector 156. The material is then crushed (if necessary) by the crusher section 180 and transferred to the bridge conveyor 158 and, finally, to the haulage conveyor 160, which transports the material to along the roadway entry 6 and eventually out of the mine. The continuous-extraction system 150 is thus able to move along the roadway entry 6 under the motive power provided by the material collector 156 and position the loading machine 118 into a draw-bell entry 9. After the loading machine 118 has finished gathering material from the draw-bell 4, the material collector 156 and the steerable wheels 117 are operated in a coordinated manner to remove the loading machine 118 from the draw-bell entry 9, tram further along the roadway entry 6 to the next draw-bell entry 9, position the loading machine 118 into the next draw-bell entry 9, and repeat the process.

Figure 13:
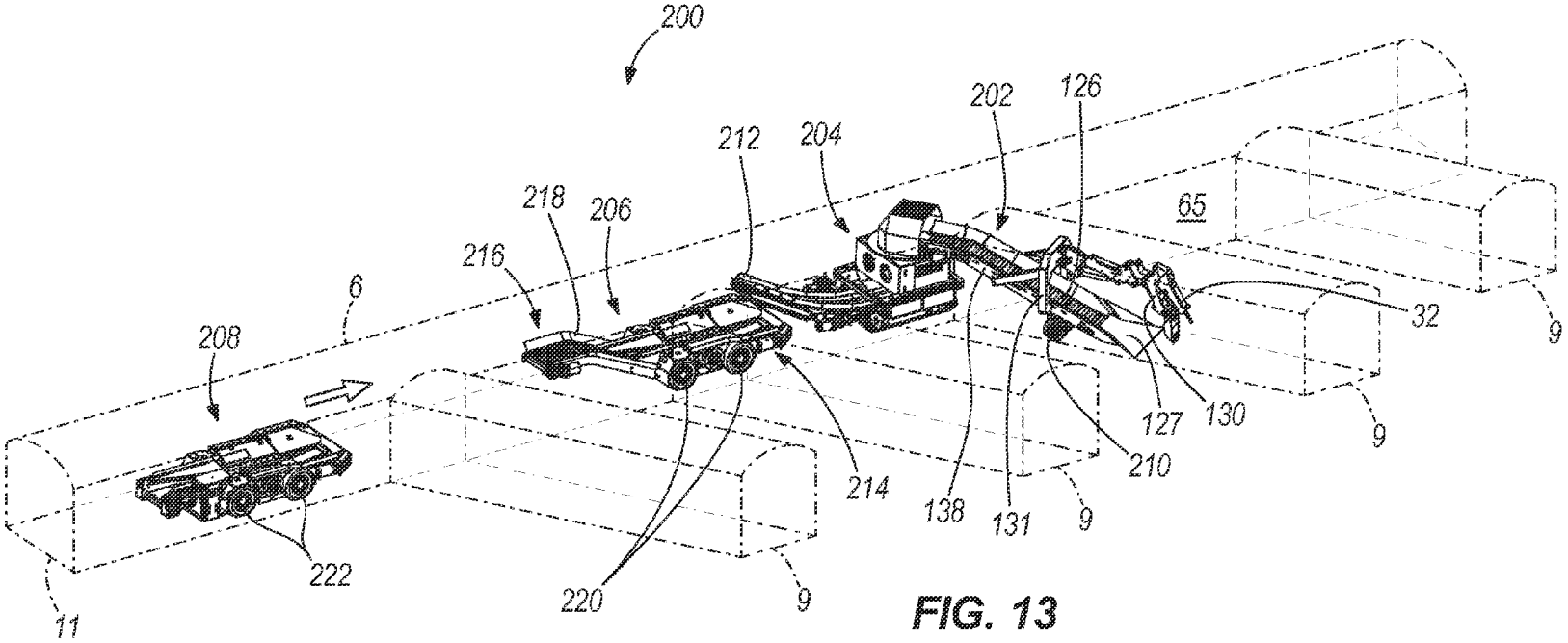
FIG. 13 is a perspective view of a continuous-extraction system according to still another embodiment of the invention, including a loader, a sizer, a material collector, and a shuttle car.
Figure 14:
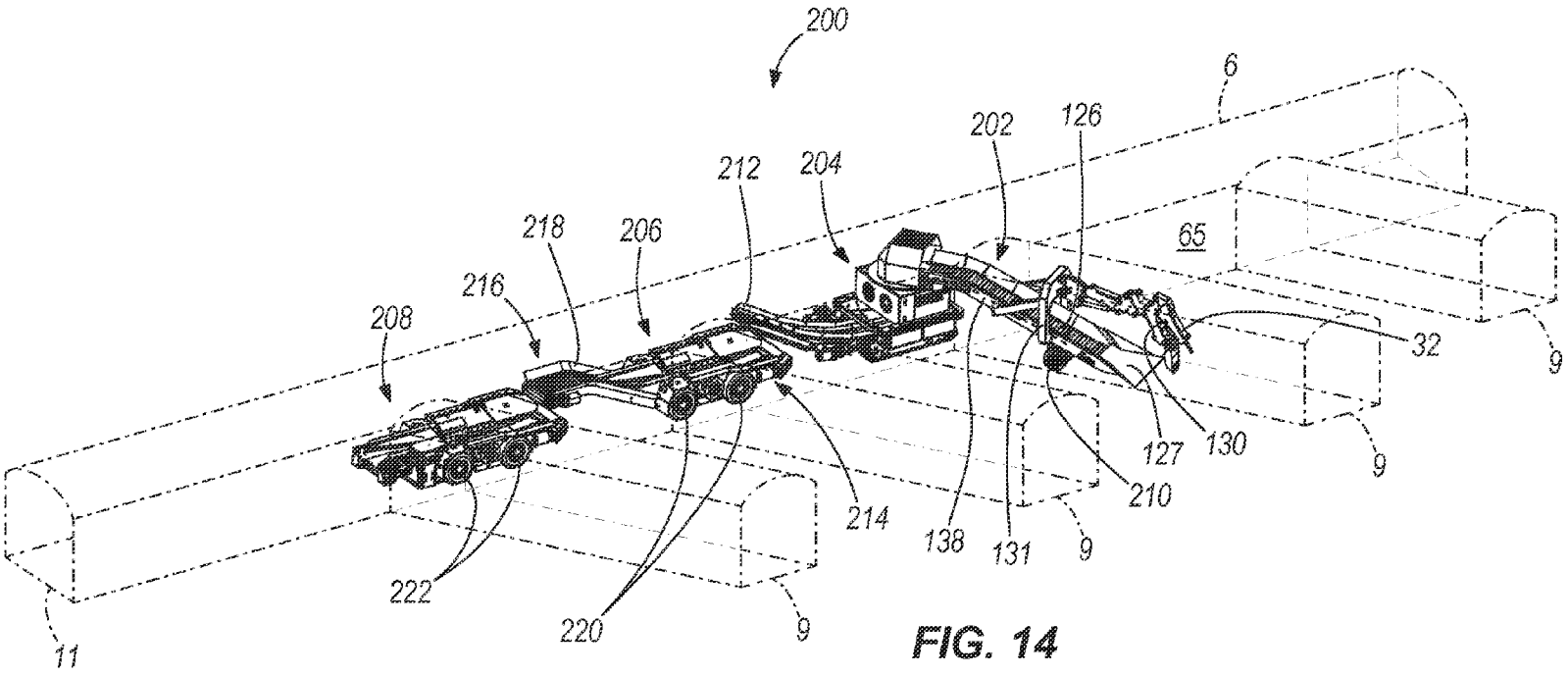
FIG. 14 is a perspective view similar to FIG. 13, illustrating the shuttle car positioned adjacent the material collector for receiving collected material from the material collector.
Figure 15:
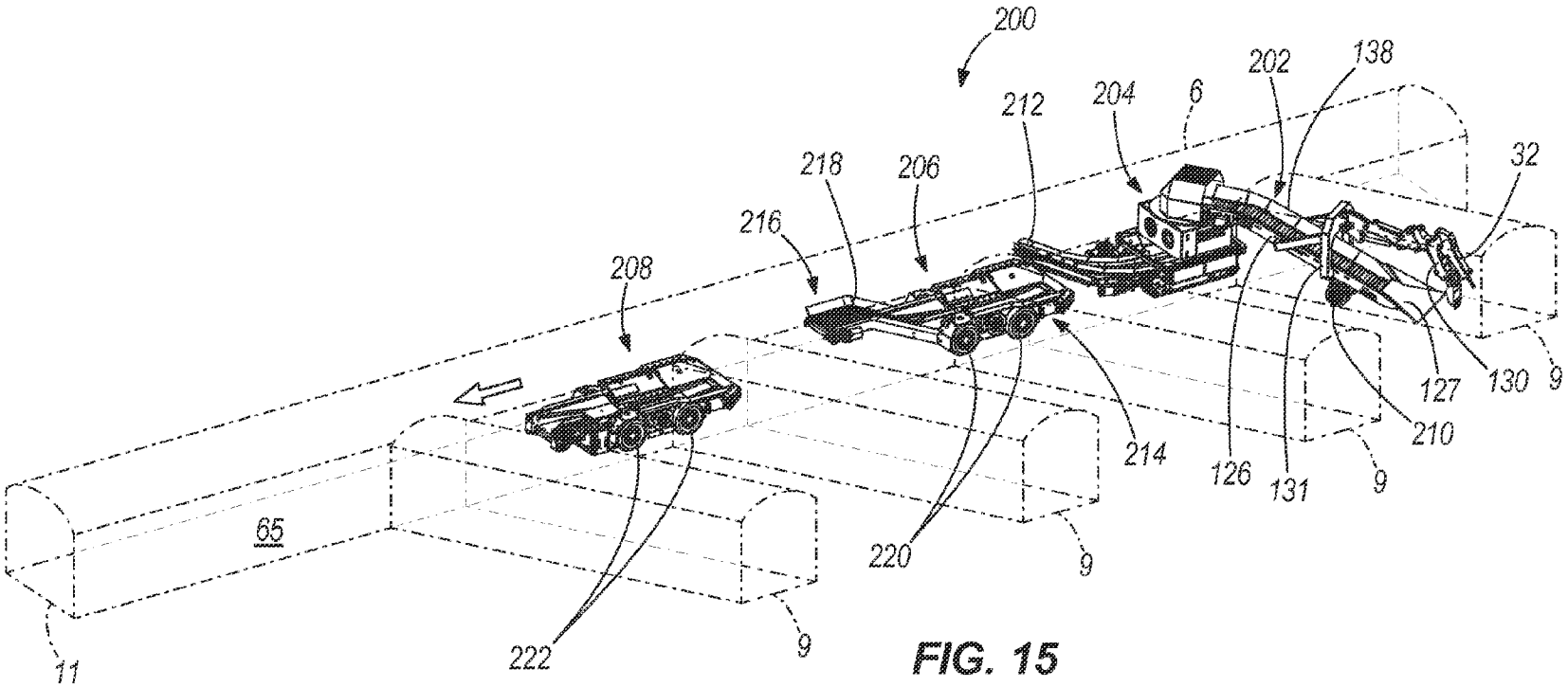
FIG. 15 is a perspective view similar to FIG. 13, illustrating the loader, sizer, and material collector as being moved along a roadway entry.

FIGS. 13-15 illustrate the continuous-extraction system 200 according to still another embodiment of the invention. This embodiment employs much of the same structure and has many of the same features as the embodiments of the continuous-extraction systems 10, 50, 150 described above in connection with FIGS. 1-12. Accordingly, the following description focuses primarily upon the structure and features that are different than the embodiments described above in connection with FIGS. 1-12. Reference should be made to the description above in connection with FIGS. 1-12 for additional information regarding the structure and features, and possible alternatives to the structure and features of the continuous-extraction system 200 illustrated in FIGS. 13-15 and described below. Structure and features of the embodiments shown in FIGS. 13-15 that correspond to structure and features of the embodiments of FIG. 1-12 are designated hereinafter with like reference numbers.

The continuous-extraction system 200 in this embodiment includes a loader 202, a sizer 204, a material collector 206 in the form of a surge car or bunker car, and a shuttle car 208. The loader 202 in this embodiment is similar to the loading machine 118 illustrated in FIG. 12. In the illustrated embodiment, the loader 202 comprises steerable wheels or treads 210 (wheels are shown in FIGS. 13-15) engageable with the mine floor 65. As such, the track rails 22 that extend into the roadway entries 6 can be eliminated. In the illustrated embodiment, the loader 202 includes the chassis 138 and the loading arm 130 movably coupled to the chassis 138. In particular, the loader 202 includes the carriage assembly 131 movable along the chassis 138, and the loading arm 130 is coupled to the carriage 131 for movement therewith. The loading arm 130 is operable to move material from the draw-bell 4 toward the chassis 138. The chassis 138 includes a feed conveyor 126, and the loading arm 130 is operable to move the removed material onto the feed conveyor 126. In the illustrated embodiment, the loader 202 includes the rock breaker or lump breaker 32 mounted to an end of the loading arm 130. The rock breaker 32 is operable to break down large lumps of ore 2 that would otherwise be too large for the loading arm 130 to collect and maneuver onto the collection tray 127. In the illustrated embodiment, the rock breaker 32 is in the form of a jack hammer, but other embodiments may include other types of rock breakers such as drills, shearing type devices, and the like.

The sizer 204 is coupled to the loader 202 for sizing the removed material. In the illustrated embodiment, the sizer 204 includes a discharge conveyor 212 for discharging the sized material onto the material collector 204. Although FIGS. 13-15 illustrate the sizer 204 as being integral with the loader 202, in some embodiments, the sizer 204 can be separate from the loader 202. For example, the sizer 204 can be coupled to the loader 202 in an articulated or coordinated manner. In some embodiments, the sizer 204 includes a self-contained power supply or drive mechanism (not shown) for moving the sizer 204 along the roadway entries 6 and pushing and pulling the loader 202 for movement into and out of the draw-bell entries 9. In this regard, the sizer 204 disclosed herein is a mobile sizer unit; i.e., the sizer 204 is movable along the mine floor 65 and can be positioned anywhere along the length of the roadway entries 6. The sizer 204 can be driven or powered by electrical, electro hydraulic, or a combination of electric and hydraulic motors, and in some embodiments may be powered at least in part by diesel power. As explained below, the sizer 204 is configured to size the removed material on a substantially continuous basis.

The material collector 206 is operable to collect the sized material. In the illustrated embodiment, the material collector 206 has a loading end 214 and a discharge end 216, and a material transport device 218 extending therebetween. The material transport device 218 can employ a plate-type conveyor, an armored-face conveyor, an endless-belt type conveyor, or other conveyors that are known in the art. In other embodiments, the material collector 206 may include one or more funnels, chutes, and/or other guide members for collecting material from the sizer 204 and guiding the collected material onto the material transport device 218. The material transport device 218 may be separate from or integral with the material collector 206, and may contain portions with different slopes.

In some embodiments, the material collector 206 may include no drive mechanisms for tramming along the roadway entries 6, and may instead be hitched, towed, pushed, or pulled like a trailer, e.g., by the mobile sizer 204 or a maintenance vehicle (not shown). The material collector 206 is therefore movable along the mine floor 65 and can be positioned anywhere along the length of the roadway entries 6. In other embodiments, the material collector 206 may be powered or driven at least in part by the self-contained power supply or drive mechanism of the sizer 204. In the illustrated embodiment, the material collector 206 includes wheels 220 engageable with the mine floor 65. Although FIGS. 13-15 illustrate the material collector 206 as including four wheels 220 rotatably coupled thereto, other embodiments may utilize other numbers of wheels 220. For example, the material collector 206 may include four to eight wheels 220. In some embodiments, at least some of the wheels 220 may be rotatably coupled to the material collector 206 via a hydraulic suspension.

The shuttle car 208 is operable to receive the collected material from the material collector 206. Moreover, the shuttle car 208 is movable along the roadway entry 6 for transferring the collected material so as to facilitate a substantially continuous extraction of the material. In the illustrated embodiment, the shuttle car 208 comprises steerable wheels or treads 222 (wheels are shown in FIGS. 13-15) engageable with the mine floor 65. In some embodiments, the shuttle car 208 may instead comprise rail-car-type wheels for movement over rails. In some embodiments, the shuttle car 208 comprises a chromium carbide overlay plate, which may allow for a relatively thick plating so as to facilitate receiving dense or heavy material.

Referring to FIG. 13, the loader 202 and sizer 204 of the continuous-extraction system 200 are positioned at the illustrated draw-bell 4 to remove and size material. The loading arm 130 pulls the removed material onto the collecting tray 127 and the material is then conveyed rearwardly (to the left in FIG. 13) by the feed conveyor 126 and dropped into the sizer 204. The material is then sized by the sizer 204 and transferred to the discharge conveyor 212 and to the material collector 206. While the material is thus being removed, sized, and collected, the shuttle car 208 trams or advances toward the material collector 206 and sizer 204.

Referring also to FIG. 14, once the shuttle car 208 is adjacent the material collector 206 and sizer 204, the sized material is transferred by the material transport device 218 from the material collector 206 to the shuttle car 208. In some embodiments, the shuttle car 208 can receive the sized material directly from the sizer 204 rather than via the material collector 206. The material collector 206 can act as a surge capacitor for the sized material. For example, if the continuous-extraction system 200 is in an overfeed or upset situation exceeding the desired feed rate of removed and/or sized material, the material collector 206 can act as a buffer or capacitor to hold the sized material until the material feed rate in the continuous-extraction system 200 is reduced to a desired range.

Referring also to FIG. 15, after the transport of the sized material is completed, the shuttle car 208 can tram backwards toward the transverse transport entry 11. While the shuttle car 208 is tramming, the loader 202, sizer 204, and material collector 206 of the continuous-extraction system 200 can continue removing and sizing the material, and then advance or tram further along the roadway entry 6 in a coordinated manner to the next draw-bell 4 to position the loader 202 into the next draw-bell entry 9 and repeat the ore-loading process. The ore 2 thus continuously moves from the loader 202 to the sizer 204, the material collector 206, and/or to the shuttle car 208, and then outside the mine. Instead of repeatedly tramming from the draw-bells 4 to a centrally-located crusher or sizer, the shuttle car 208 is required to tram only a relatively short distance between the transverse transport entries 11 and the mobile sizer 204 and material collector 206, which can save time and improve production rates.

In a block-caving infrastructure 8 with multiple draw-bells 4, a plurality of continuous-extraction system 200 can be employed to further improve production rates. Some embodiments can also include automation equipment operable to position the continuous-extraction system 200 at draw-bells 4 and to control other movements as needed. For example, radio or cable communication links can be used for automation, remote operation, or both.

Although the invention has been described in detail with reference to certain preferred embodiments, variations and modifications exist within the scope and spirit of one or more independent aspects of the invention as described.

The invention claimed is:

1. A material extraction system for an underground mine, the mine including a roadway entry and a draw-bell entry intersecting the roadway entry and affording access to a draw-bell, the system comprising:

a loader movable from the roadway entry into the draw-bell entry for removing material from the draw-bell;

a mobile sizer coupled to the loader for sizing the removed material;

a material collector operable to collect the sized material, the material collector having a loading end and a discharge end, and a material transport device extending therebetween; and a shuttle car operable to receive the collected material from the material collector, the shuttle car being movable along the roadway entry for transferring the collected material so as to facilitate a substantially continuous extraction of the material, wherein the sizer is configured to size the removed material on a substantially continuous basis by receiving removed material from a feed conveyor on the loader and discharging the sized material to the material collector with a discharge conveyor, wherein the material collector is operable as a buffer to hold the sized material until the shuttle car is in a position relative to the material collector to receive the collected material from the material collector.

2. The system of claim 1, wherein the sizer includes a self-contained power supply.

3. The system of claim 2, wherein the material collector is powered at least in part by the self-contained power supply of the sizer.

4. The system of claim 1, wherein the material collector includes wheels engageable with a mine floor.

5. The system of claim 1, wherein the loader includes a chassis and a loading arm movably coupled to the chassis and operable to move material from the draw-bell toward the chassis.

6. The system of claim 5, wherein the loading arm moves the removed material onto the feed conveyor.

7. The system of claim 5, wherein the loader includes a rock breaker mounted to an end of the loading arm.

8. The system of claim 5, wherein the loader further includes a carriage movable along the chassis, and wherein the loading arm is coupled to the carriage for movement therewith.

9. The system of claim 1, wherein the shuttle car comprises steerable wheels engageable with a mine floor.

10. The system of claim 1, wherein the shuttle car comprises wheels for movement over rails.

11. The system of claim 1, wherein at least a portion of the shuttle car comprises a chromium carbide overlay plate.

12. The system of claim 1, wherein the removed material is received by the sizer at an upper portion of the sizer and the sized material is discharged by the sizer at a lower portion of the sizer.

13. The system of claim 12, wherein the discharge conveyor extends upwardly from the lower portion of the sizer to a position above a portion of the material collector.

14. The system of claim 1, wherein the material collector places the sized material at a substantially elevated position relative to a mine floor.

15. The system of claim 1, wherein the loader moves into the draw-bell entry to remove material while the mobile sizer, the material collector, and the shuttle car remain in the roadway entry.

16. A method of extracting material for an underground mine, the mine including a roadway entry and a draw-bell entry intersecting the roadway entry and affording access to a draw-bell, the method comprising:

moving a loader from the roadway entry into the draw-bell entry;

removing material from the draw-bell using the loader;

sizing the removed material on a substantially continuous basis using a mobile sizer that is coupled to the loader by a feed conveyor;

discharging the sized material from the sizer using a discharge conveyor;

collecting the sized material from the discharge conveyor on a material collector, the material collector acting as a buffer to hold the sized material until the shuttle car is in a position relative to the material collector to receive the collected material from the material collector; and transferring the collected material along the roadway entry using a shuttle car so as to facilitate a continuous extraction of the material.

17. The method of claim 16, wherein the material collector includes a loading end and a discharge end and a material transport device extending therebetween, and the collected material is conveyed using the material transport device for transferring onto the shuttle car.

18. The method of claim 16, wherein the material collector engages a mine floor with wheels.

19. The method of claim 16, wherein the shuttle car engages a mine floor with steerable wheels.

20. The method of claim 16, wherein discharging of the sized material from the sizer occurs at a lower portion of the sizer and further includes raising the sized material upwardly to a position above a portion of the material collector.

21. The method of claim 16, wherein the sized material is placed at a substantially elevated position relative to a mine floor.

22. A material extraction system for an underground mine, the mine including a roadway entry and a draw-bell entry intersecting the roadway entry and affording access to a draw-bell, the system comprising:

a loader movable from the roadway entry into the draw-bell entry for removing material from the draw-bell;

a mobile sizer coupled to the loader for sizing the removed material on a substantially continuous basis;

a material collector operable to store the sized material, the material collector having a loading end and a discharge end, a material transport device extending therebetween, and wheels engageable with a mine floor; and a shuttle car operable to receive the collected material from the material collector, the shuttle car including steerable wheels engageable with a mine floor for moving along the roadway entry for transferring the collected material so as to facilitate a substantially continuous extraction of the material, wherein the sizer is configured to size the removed material on a substantially continuous basis by receiving removed material from a feed conveyor on the loader and discharging the sized material to the material collector with a discharge conveyor, wherein the material collector is operable as a buffer to hold the sized material until the shuttle car is in a position relative to the material collector to receive the collected material from the material collector.

* * * * *